US007021666B2

(12) United States Patent
Hare

(10) Patent No.: US 7,021,666 B2
(45) **Date of Patent: *Apr. 4, 2006**

(54) TRANSFERABLE GREETING CARDS

(75) Inventor: Donald Hare, Hawley, PA (US)

(73) Assignee: Foto-Wear Inc., Milford, PA (US)

( * ) Notice: Subject to any disclaimer, the term of this patent is extended or adjusted under 35 U.S.C. 154(b) by 445 days.

This patent is subject to a terminal disclaimer.

(21) Appl. No.: 09/791,755

(22) Filed: Feb. 26, 2001

(65) Prior Publication Data

US 2002/0008381 A1 Jan. 24, 2002

Related U.S. Application Data

(60) Provisional application No. 60/185,054, filed on Feb. 25, 2000.

(51) Int. Cl.
*B42D 15/00* (2006.01)

(52) U.S. Cl. ..... 283/117; 283/98; 283/100; 283/101; 428/40.1; 428/42.2; 428/42.3; 428/914; 430/126; 156/60

(58) Field of Classification Search ..... 283/98, 283/100, 101, 117; 428/40.1, 42.2, 42.3, 428/914; 156/60; 430/126
See application file for complete search history.

(56) References Cited

U.S. PATENT DOCUMENTS

| | | | | | |
|---|---|---|---|---|---|
| 2,363,472 | A | | 11/1944 | Ritter et al. | |
| 3,790,439 | A | * | 2/1974 | La Perre et al. | 428/41.3 |
| 4,089,722 | A | * | 5/1978 | Holoubek | 156/235 |
| 4,200,222 | A | | 4/1980 | Feuer | |
| 4,322,467 | A | * | 3/1982 | Heimbach et al. | 428/200 |
| 5,102,171 | A | * | 4/1992 | Saetre | 283/117 |
| 5,271,990 | A | * | 12/1993 | Kronzer et al. | 428/195 |
| 5,280,006 | A | * | 1/1994 | Beck et al. | 503/227 |
| 5,284,365 | A | * | 2/1994 | Stuart | 283/117 |
| 5,525,574 | A | * | 6/1996 | Edwards | 503/227 |
| 5,798,179 | A | * | 8/1998 | Kronzer | 428/32.81 |
| 5,948,586 | A | * | 9/1999 | Hare | 430/138 |
| 5,951,057 | A | * | 9/1999 | Spector | 283/117 |
| 5,981,009 | A | * | 11/1999 | Iacono et al. | 428/40.1 |
| 6,083,656 | A | * | 7/2000 | Hare et al. | 430/138 |
| 6,087,061 | A | * | 7/2000 | Hare et al. | 430/256 |
| 6,096,475 | A | * | 8/2000 | Hare et al. | 430/263 |
| 6,106,022 | A | * | 8/2000 | Badash et al. | 283/81 |
| 6,290,798 | B1 | * | 9/2001 | Onishi et al. | 156/230 |
| 6,338,932 | B1 | * | 1/2002 | Hare et al. | 430/256 |
| 6,358,660 | B1 | * | 3/2002 | Agler et al. | 430/126 |
| 6,380,132 | B1 | * | 4/2002 | Mihara et al. | 503/227 |
| 6,383,710 | B1 | * | 5/2002 | Hare et al. | 430/256 |
| 6,410,200 | B1 | * | 6/2002 | Williams et al. | 430/126 |
| 6,423,466 | B1 | * | 7/2002 | Hare et al. | 430/263 |
| 6,482,285 | B1 | * | 11/2002 | Cross | 156/230 |
| 6,682,624 | B1 | * | 1/2004 | Schlier | 156/230 |
| 6,786,994 | B1 | * | 9/2004 | Williams et al. | 156/240 |
| 2001/0027617 | A1 | * | 10/2001 | McGuiness | 40/124.11 |
| 2001/0041301 | A1 | * | 11/2001 | Hare et al. | 430/235 |
| 2001/0044068 | A1 | * | 11/2001 | Hare et al. | 430/256 |
| 2001/0051265 | A1 | * | 12/2001 | Williams et al. | 428/343 |
| 2002/0015908 | A1 | * | 2/2002 | Hare et al. | 430/263 |
| 2002/0061459 | A1 | * | 5/2002 | Hare et al. | 430/256 |

FOREIGN PATENT DOCUMENTS

| | | |
|---|---|---|
| FR | 2 430 318 A | 2/1980 |
| WO | WO 88/01419 | 2/1988 |

* cited by examiner

*Primary Examiner*—Boyer Ashley
*Assistant Examiner*—Mark Henderson
(74) *Attorney, Agent, or Firm*—Birch, Stewart, Kolasch, Birch, LLP

(57) ABSTRACT

The invention relates to a greeting card containing a thermal transfer sheet. The transfer sheet of the present greeting card includes a (1) a support; (2) optionally at least one transfer layer; and (3) an image or an image receiving layer. According to the present greeting card, if the transfer material contains only (1) a support, and (3) an image, the image is not formed using a transferable ink. However, transferable inks may be used under specific conditions.

54 Claims, 5 Drawing Sheets

TRANSFERABLE GREETING CARDS

The contents of Provisional Application U.S. Ser. No. 60/185,054, filed Feb. 25, 2000, on which the present application is based and benefit is claimed under 35 U.S.C. § 119(e), is herein incorporated by reference.

BACKGROUND OF THE INVENTION

1. Field of the Invention

The present invention relates generally to greeting cards, and more particularly to a greeting card having an image transfer material. The image transfer material can be pre-printed with an image or the image may be subsequently added to the image transfer material.

The image transfer material of the greeting card can be applied to a receptor element, such as cotton or cotton/polyester blend fabrics or the like.

2. Description of the Prior Art

Greeting cards represent an old and expansive market in the world. However, as a new twist to an old concept, some companies have included detachable decals with their greeting cards.

For example, U.S. Pat. No. 5,102,171 describes a greeting card having a peel-off sheet formed of static cling vinyl on which an image is printed. This sheet may be attached by electrostatic attraction to a non-porous surface. Also, U.S. Pat. No. 5,284,365 describes a greeting card having a cut out containing a removable message section that can be removed from the basic greeting card, and by means of adhesive or magnetic material, applied to a surface. However, neither U.S. Pat. No. 5,102,171 nor U.S. Pat. No. 5,284,365 is heat-transferable.

A greeting card containing a heat-transferable decal section is described by U.S. Pat. No. 5,951,057. According to this patent, a greeting card may include a detachable decal section having printed thereon an image of, for example, a cartoon character. The decal section in U.S. Pat. No. 5,951,057 is printed with a transferable ink and the remainder of the card is printed with a non-transferable ink. However, U.S. Pat. No. 5,951,057 discloses only greeting cards containing decals which are pre-printed with transferable inks.

However, the prior art fails to describe greeting cards containing heat-transferable materials which are pre-printed with an image formed from something other than a transferable ink. The prior art also fails to describe greeting cards containing decals which are not pre-prints, but rather blank materials to which a specific image, of the user's choice, may be added before heat-transferring to a receptor element.

SUMMARY OF THE INVENTION

The present invention provides for novel greeting cards which contain a variety of heat-transferable materials. In particular, the present greeting cards contain heat transferable materials which (1) contain pre-printed images not formed from transferable inks, or (2) are not pre-printed with an image but are receptive to being printed with any type of image formed from any material, dye, colorant, etc.

These heat-transferable materials may be used to heat-transfer images onto receptor elements such as tee shirts. This is much less expensive and more personalized than store bought tee shirts. Accordingly, the recipients of the present greeting cards may wear and display apparel carrying designs that were formed on the transfer materials of the present invention in a timely and cost efficient manner.

BRIEF DESCRIPTION OF THE DRAWINGS

The present invention will become more fully understood from the detailed description given hereinbelow, and the accompanying drawings that are given by way of illustration only and thus are not limitive of the present invention, and wherein:

FIG. 3 illustrates the step of ironing the transfer element of the present invention onto a tee shirt or the like.

DETAILED DESCRIPTION OF THE INVENTION

The present invention includes a greeting card containing a thermal transfer sheet. The transfer sheet of the present invention includes a (1) a support; and (2) an image (e.g. pre-imaged) or an image receiving layer (e.g. capable of receiving an image). The present transfer sheet may also contain a transfer layer between the support and the image or image receiving layer. According to the present invention, the transfer layer and the image or image receiving layer may be combined in the same layer. Furthermore, the image or an image placed on or within the image receiving layer may be transferred to a receptor element.

Also, according to the present invention, if the transfer material contains only (1) a support, and (2) an image, the image is not formed using a transferable ink. However, if any other components are present, the image formed may be formed using a transferable ink. For example, if a transfer layer is present, or an image receiving layer is utilized, or if any other intermediate layer is present, any type of ink may be used.

According to the present greeting card, several types of images and image receiving layers may be used in the transfer material. These layers will be described in more detail below.

The present greeting cards also provides for optional layers such as barrier layers, pressure sensitive adhesive layers, transfer blocking overcoat layers, non-water dispersible polymer layers, antistatic layers, and/or opaque layers to be utilized in the transfer material.

The present invention also provides for a kit containing the present greeting card and instructions for transferring an image onto a receptor element, such as a tee shirt. The kit may optionally contain markers, paint, crayons, tee-shirts, prep-sheetsand other design aids.

A. The Greeting Card

The greeting card according to the present invention may be directed to the subject matter of any greeting card conventionally known. This card may be for occasions such as birthdays, weddings, anniversaries, Christmas, Easter, Thanksgiving, Valentine's Day, St. Patrick's Day, and the like. The greeting card may also contain congratulations and condolences. Or, the greeting card can be entirely personalized by the user.

Figure 4:
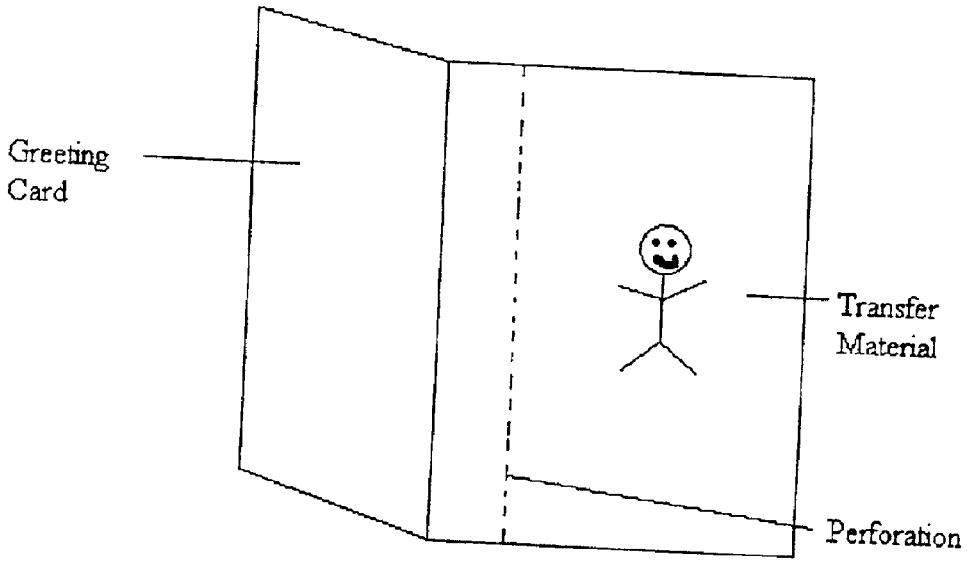
FIG. 4 illustrates an embodiment of the present greeting card where the transfer sheet is separated from the support of the greeting card by perforations.
Figure 5:
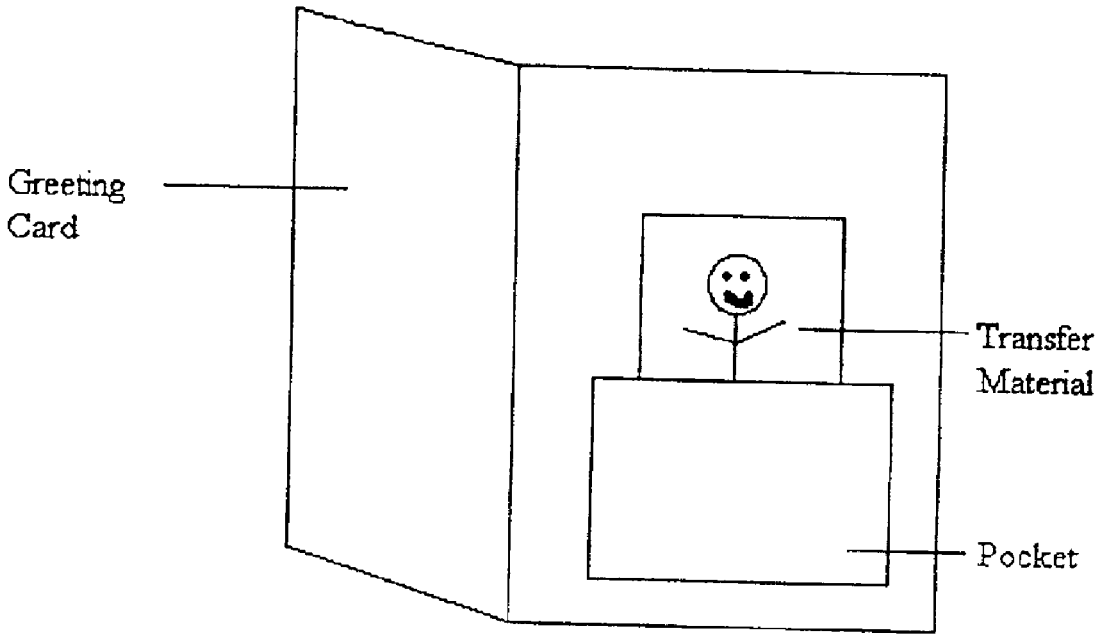
FIG. 5 illustrates another embodiment of the present greeting card where the transfer sheet is carried within a pocket in the greeting card.

In particular, the greeting card according to the present invention includes a transfer material, which will be described below. This transfer material may be an integral part of the greeting card, or be detachable. If the transfer material is integral of the greeting card, it will be coated on all or a desired portion of the support of the greeting card. This desired portion may be separated from the greeting card by perforations prior to transfer. Alternatively, there may be no need for perforations and the greeting card may simply be used as the transfer material. An example of the integral embodiment of the greeting card is illustrated by FIG. 4. In FIG. 4 the transfer material is separated from the greeting card by perforations formed in the support. If the transfer material is detachable, it is carried independently within the greeting card, for example, loose inside the card, or within a pocket or pouch. An example of the detachable embodiment is illustrated by FIG. 5. In FIG. 5, the transfer material is carried within a pocket that is attached to the greeting card.

B. The Transfer Material

Several types of transfer materials are suitable for use with the present greeting card. These transfer materials are designed for transferring images to receptor elements, such as textiles. Textiles, such as tee shirts, having a variety of designs thereon have become very popular in recent years. Many shirts are sold with pre-printed designs to suit the tastes of consumers. In addition, many customized tee shirt stores are now in business which permit customers to select designs or decals of their choice. Processes have also been proposed which permit customers to create their own designs on transfer sheets for application to tee shirts by use of a conventional iron, such as described in U.S. Pat. No. 4,244,358 issued Sep. 23, 1980. Furthermore, U.S. Pat. No. 4,773,953 issued Sep. 27, 1988, is directed to a method for utilizing a personal computer, a video camera or the like to create graphics, images, or creative designs on a fabric. These types of transfer sheets are suitable for use in the present greeting card.

Other types of transfer sheets are also suitable for use in the present greeting card. These will be described below:

U.S. Pat. No. 4,980,224 is directed to a method and transfer sheet for transferring creative and personalized designs onto a tee shirt or similar fabric is described. The design can be created manually, electronically or a combination of both using personal computers, video cameras or electronic photocopiers. The transfer sheet includes a polymer-based iron-on transfer sheet supplied with an additional overcoating of resin mixed with abrasive particles. When cured, the abrasive particles in combination with the resin serve to enhance the receptivity of the transfer sheet to various inks and wax based crayons used in the creation and coloring of the designs.

U.S. Pat. No. 4,966,815 is directed to a method for creating personalized, creative designs or images on a fabric such as a tee shirt or the like using a personal computer system. The design is first created by hand on the monitor screen of the computer system. The design so created is then printed onto a heat transfer sheet. The design may also be an image, such as a picture created by a video camera.

U.S. Pat. No. 5,139,917 (which is a divisional of the application from which issued U.S. Pat. No. 5,236,801) is directed to an imaging system wherein the developed image and non-image areas are transferred to a receptor element by a transfer coating layer. The transfer layer of U.S. Pat. No. 5,139,917 is coated on the support of the imaging sheet and/or developer sheet and comprises a material capable of holding developed images and non-image areas that can be transferred to a receptor surface upon the application of heat to the rear surface of the support. The transfer coating layer is capable of liquefying when heated and resolidifying when heat is removed. U.S. Pat. No. 5,139,917 is also directed to a method of applying an image to a receptor element which comprises the steps of exposing an imaging system based on photosensitive encapsulates, developing the exposed element to form an image, positioning the front surface of the developed element containing the transfer layer of the invention against the receptor element, and applying heat to the rear surface of the element to transfer the developed image and non-image area to the receptor element.

U.S. Pat. No. 5,620,548 is directed to a silver halide photographic transfer element and to a method for transferring an image from the transfer element to a receptor surface.

U.S. Pat. No. 5,833,790 is directed to a method of creating personalized, transferable artwork, which comprises the steps of selecting artwork or preselected images, inserting said artwork or preselected images into a clear folder or beneath a clear sheet, said clear folder or clear sheet having no printing or form-work thereon and being capable of being written upon, handwriting onto the clear folder or clear sheet, thereby personalizing said clear folder or clear sheet, copying said art-work or preselected images and said clear folder or clear sheet having handwriting thereon onto a transfer material, and transferring said art-work or preselected images together with said handwriting onto a receptor element, thereby preserving the original artwork for reuse. U.S. Pat. No. 5,833,790 demonstrates the only way personalization, such as handwriting, can be transferred onto a receptor element, such as a shirt, in correct order using equipment without an electronic reverse imaging capability.

U.S. Pat. Nos. 4,185,957 and 4,139,343 disclose sublimation dyes in an ink base with ethyl cellulose. In these patents, textiles are colored with water-insoluble dyestuffs that undergo sublimation. The dye on the substrate is caused to sublime or be vaporized onto the surface of the textile to penetrate the fibers and to be entrained therein.

U.S. Pat. No. 5,269,865 discloses a transfer material and colorant for use in a thermal transfer recording method capable of providing a recorded image, which is removable by lift-off correction, on a recording medium (i.e. paper).

U.S. Pat. No. 5,487,614 discloses a transferable material containing heat activated, sublimation ink solids. The ink solids are transferred by means of a printer from a ribbon to a medium. The heat activated ink solids used do not have an affinity for highly absorbent fibers such as cotton. Thus, a printer ribbon panel having a polymeric coating thereon acts as a surface coating for the cotton component of the substrate. The heat sublimates the ink solids during the transfer from the medium to the substrate.

U.S. Pat. No. 5,575,877 discloses a computer driven means to print an image by means of selective transfer of inks or dyes. An ink or dye is printed from a ribbon to a medium. A 'polymeric surface preparation material' is then printed over the design formed by the ink or dye. Optionally, the surface preparation material may be mixed with the ink formulation when, for example, one or more of the panels of the ribbon of the multiple pass thermal printer incorporates a polymeric surface preparation material which is printed onto the medium with the ink and binder.

U.S. Pat. Nos. 5,268,052 and 4,870,427 disclose a thermal transfer of a thermoplastic ink formulation from a transfer sheet (ink ribbon) onto a receiver sheet. The ink ribbon contains thereon a heat-fusible binder such as wax and heat fusible resin.

U.S. application Ser. No. 08/962,296, filed Oct. 31, 1997 is directed to a transfer material wherein silver halide light sensitive grains are dispersed within a carrier which functions as a transfer layer, and does not have a separate transfer layer.

Other types of heat transfer sheets are known in the art. For example, U.S. Pat. No. 5,798,179 is directed to a printable heat transfer material using a thermoplastic polymer such as a hard acrylic polymer or poly(vinyl acetate) as a barrier layer, and has a separate film-forming binder layer. U.S. Pat. No. 5,271,990 relates to an image-receptive heat transfer paper which includes an image-receptive melt-transfer film layer comprising a thermoplastic polymer overlaying the top surface of a base sheet. U.S. Pat. No. 5,502,902 relates to a printable material comprising a thermoplastic polymer and a film-forming binder. U.S. Pat. No. 5,614,345 relates to a paper for thermal image transfer to flat porous surfaces, which contains an ethylene copolymer or a ethylene copolymer mixture and a dye-receiving layer.

Other examples of heat transfer materials are disclosed by, for example, Provisional application 09/541,083, filed Mar. 30, 2000 which relates to a polymeric composition comprising an acrylic dispersion, an elastomeric emulsion, a plasticizer, and a water repellant. Provisional application 60/133,861, filed May 12, 1999 relates to a barrier layer. The barrier layer of 60/133,861 provides for "cold peel," "warm peel" and "hot peel" applications and comprises thermosetting and/or ultraviolet (UV) curable polymers. Provisional application 60/134,849, filed May 19, 1999 relates to a transfer material having a transfer blocking overcoat and to a process using said heat transferable material having a transfer blocking overcoat. The transfer blocking overcoat of 60/134,849 allows for the reduction of the polymer halo around the transferred image while still providing for the "hand" or feel of the substrate after transferring.

Some of the above-mentioned applications contain specific systems for forming clear images which are subsequently transferred onto the receptor element. However, other heat transfer systems exist, for example, those disclosed by U.S. Pat. Nos. 4,021,591, 4,555,436, 4,657,557, 4,914,079, 4,927,709, 4,935,300, 5,322,833, 5,413,841, 5,679,461, and 5,741,387.

U.S. application Ser. No. 08/970,424, filed Nov. 11, 1997 is directed to a transfer element using CYCOLOR technology and to a method of transferring a developed image to a receptor surface, wherein the imaging system comprises a support, microcapsules, developer, and transfer material.

U.S. application Ser. No. 09/191,373, filed Nov. 13, 1998, requires that the microcapsules and transfer material are in separate layers.

U.S. application Ser. No. 08/479,409, filed Jun. 7, 1995 is directed to a silver halide photographic transfer element which comprises a support having a front and rear surface, a transfer layer on the front surface of the support, the transfer layer comprising a material capable of holding an image that can be transferred to a receptor element upon the application of energy to the rear surface of the support, and at least one silver halide light sensitive emulsion layer on the front surface of the support.

U.S. application Ser. No. 09/138,553, filed Aug. 24, 1998 is directed to a silver halide photographic element, which comprises a support having a front and rear surface; a transfer layer having a melting point of at least 65° C. and which is capable of transferring and adhering developed image and non-image areas from said front surface of said support upon the application of heat energy to the rear surface of the support, the transfer layer strips from the front surface of the support by liquefying and releasing from the support when heated, said liquefied transfer layer providing adherence to a receptor element by flowing onto the receptor element and solidifying thereon, the adherence does not require an external surface adhesive layer; and at least one silver halide light sensitive emulsion layer containing light sensitive silver halide grains.

U.S. patent application Ser. No. 09/191,369, filed Nov. 13, 1998 is directed to a transfer material comprising a support having a front and rear surface, at least one transfer layer coated on the front surface of the support, and at least one thermal recording layer coated on top of the outermost transfer layer. The thermal recording layer contains heat-responsive microcapsules capable of separating an inner phase within the microcapsules from an outer phase contained outside the microcapsules. The inner phase of the microcapsules is capable of reacting with the outer phase to create a color forming element.

U.S. Provisional Application No. 60/156,593, filed Sep. 29, 1999 is directed to a dye sublimation transfer paper comprising a support having a first and a second surface, a barrier layer having a first and second surface, wherein the first surface of the barrier layer is applied to the first surface of the support and a sublimation dye image is applied to the second surface of the barrier layer. Lastly, the first surface of a polyester layer having a first and a second surface, is applied to the sublimation dye image, provided that the polyester layer does not comprise thermosetting materials.

U.S. Provisional Application No. 60/130,500, filed Apr. 23, 1999 is directed to a coated transfer sheet comprising a substrate having a first and second surface; at least one thermosetting and/or UV curable polymeric barrier layer overlaying said first surface, at least one release layer overlaying said barrier layer or, when the barrier layer is not present, overlaying the substrate; and an optional image receiving layer comprising an ethylene acrylic acid co-polymer dispersion; wherein the coated transfer sheet exhibits cold peel, hot peel, or warm peel properties when transferred, and may be used in electrostatic printers and copiers or other devices in which toner particles are image-wise applied to a substrate. The addition of elastomeric polymers and polyurethanes help provide enhanced wash stability and chemical stability.

U.S. Provisional Application No. 60/157,018 is directed to an image transfer material and a process for printing images using toner, pigmented, and/or water soluble colorants from a heat transferable material having an image receiving layer, which image receiving layer contains 1) precipitated calcium carbonate (PCC), 2) polyvinylpyrrolidone (PVP), or 3) a combination of PCC and PVP (PCC/PVP).

U.S. Provisional Application No. 60/129,366, filed Apr. 15, 1999 is directed to a heat sealable element, which comprises a support, a heat sealing layer comprising a thermoplastic polymer which melts in the range of 50–250° C., a wax which melts in the range of 50–250° C., or combinations thereof, and an image layer which comprises at least one polymer which is capable of selectively receiving and retaining water base colorants.

U.S. application Ser. No. 09/637,082, filed Aug. 11, 2000 is directed to a heat-setting label sheet that is a polymeric transfer sheet that can be marked and transferred by the consumer. Also encompassed by Ser. No. 09/637,082 is a method of transferring the heat-setting label sheets. The heat-setting label sheets of Ser. No. 09/637,082 comprise a support; an optional pressure sensitive adhesive layer; an adhesion layer (or release layer) comprising a thermoplastic polymer which melts in the range of 50–250° C., a wax which melts in the range of 50–250° C., or combinations thereof; an optional opaque layer comprising a styrene-butadiene latex, thermoplastic polymer, elastomer, and optional pigment; and a second optional opaque layer comprising vinyl acetate-ethylene copolymer, thermoplastic elastomer, elastomer and optional pigment. The heat-setting label sheet of Ser. No. 09/637,082 can be imaged by an electrostatic printer or copier, ink jet printer, offset or screen printing, craft-type marking, and the like.

U.S. Provisional Application No. 60/134,849, filed May 12, 1999 is directed to a heat-setting label sheet that is a polymeric transfer sheet that can be marked and transferred by the consumer. Also encompassed by this application is a method of transferring the heat-setting label sheets. The heat-setting label sheets of this application comprise a support; an optional pressure sensitive adhesive layer; an Adhesion Layer (or Release Layer) comprising a thermoplastic polymer which melts in the range of 50–250° C., a wax which melts in the range of 50–250° C., or combinations thereof; an optional opaque layer comprising a styrene-butadiene latex, thermoplastic polymer, elastomer, and optional pigment; and a second optional opaque layer comprising vinyl acetate-ethylene copolymer, thermoplastic elastomer, elastomer and optional pigment. The heat-setting label sheet of this application can be imaged by an electrostatic printer or copier, ink jet printer, offset or screen printing, craft-type marking, and the like.

U.S. patent application Ser. No. 09/366,300, filed Aug. 2, 1999 is directed to a water-soluble transferable colorant composition which comprises a water soluble transfer material and a colorant wherein the transferable colorant is capable of transferring from a substrate and adhering to a receptor element upon the application of heat energy and pressure to the rear surface of the substrate, the transferable colorant strips from the front surface of the substrate when heated, the transferable colorant providing adherence to said receptor element by flowing onto said receptor element and solidifying thereon.

Limitations of the above Transfer Materials

As discussed above, the present invention includes a greeting card containing a thermal transfer sheet. The transfer sheet includes a (1) a support; and (2) an image or an image receiving layer. However, if the transfer material contains only (1) a support, and (2) an image, the image is not formed using a transferable ink. Although, if any additional components are present, the image formed may be formed using a transferable ink. For example, if a transfer layer is present, or an image receiving layer is utilized, or if any other intermediate layer is present, any type of ink may be used.

Thus, some of the above-discussed applications or patents are useful with the present invention to the extent that they (1) fall within the allowable transfer materials discussed in the preceding paragraph.

Additionally, several Provisional U.S. Applications are discussed above. Each of these applications is fully compatible with the present greeting card. In other words, each of the transfer materials discussed in the U.S. Provisional Applications above are useful in the present greeting card, regardless of the above-discussed limitations concerning transferable inks. For convenience, each of these U.S. Provisional applications are been listed below:

U.S. Provisional Application Nos. 60/127,625, 60/129,366, 60/130,500, 60/133,861, 60/134,849, 60/148,562, 60/157,018, and 60/156,593. U.S. Provisional application No. 60/148,562 is now U.S. application Ser. No. 09/637,082 and U.S. Provisional application No. 60/127,625 is now U.S. application Ser. No. 09/541,083.

Each of the above provisional applications, applications and patents describe transfer materials which are useful in the present invention. However, in order to more fully describe possible variations of the transfer material useful in the present greeting card, the components of the transfer material will be discussed.

1. Support

The support is a thin flexible, but non-elastic carrier sheet upon which the release layer can be formed and serves as a support for the production of an image on the transfer material and from which the image can be released. The support is not particularly limited and may be any conventional support sheet which is suitably flexible and upon which the heat release layer, image receiving layer, and optional image can be formed. Typically, the support sheet is a paper web, plastic film, metal foil, wood pulp fiber paper, vegetable parchment paper, lithographic printing paper or similar material.

In one embodiment of the present invention the support provides a surface that will promote or at least not adversely affect image adhesion and image release to the receptor. An appropriate support material may include but is not limited to a cellulosic nonwoven web or film, such as a smooth surface, heavyweight (approximately 24 lb.) laser printer or color copier paper stock or laser printer transparency (polyester) film. However, highly porous supports are less preferred because they tend to absorb large amounts of the coating and/or toner in copiers without providing as much release. The particular support used is not known to be critical, so long as the substrate has sufficient strength for handling, copying, coating, heat transfer, and other operations associated with the present invention. In accordance with some embodiments of the present invention, the support may be the base material for any printable material, such as described in U.S. Pat. No. 5,271,990.

2. The Optional Barrier Layer

Suitable barrier layers include the barrier layers disclosed in U.S. application Ser. No. 09/541,083, filed Mar. 30, 2000, U.S. provisional application 60/130,500 filed on Apr. 23, 1999 and 60/133,861 filed May 12, 1999, and U.S. Pat. Nos. 5,501,902, 5,271,990, 5,242,739 and 5,798,179, which are herein incorporated by reference. The barrier layer is coated on the support and assists in releasing the image.

In one embodiment, the barrier layer comprises a polymer dispersion. For example, the polymer dispersion may comprise one or more of the components selected from the group consisting of polyacrylates, styrene-butadiene copolymers, ethylene-vinyl acetate copolymers, nitrile rubbers, poly (vinylchloride), poly(vinylacetate) and ethylene-acrylate copolymers. Preferably, the polymer dispersion comprises polyvinyl acetate dibutyl maleate copolymer.

In another embodiment, the barrier layer may comprise a polymer selected from the group consisting of a thermosetting polymer, an ultraviolet curable polymer, and combinations thereof, or the barrier layer may comprise acetone, 2-propanol, and polymethyl methacrylate. The thermosetting polymer is preferably selected from the group consisting of thermosetting acrylic polymers and blends; thermosetting polyurethanes, block polyurethanes and aromatic-functional urethanes; thermosetting polyester polymers and co-polymer systems; aromatic-functional vinyl polymers and polymer blends; and thermosetting epoxy resins.

Materials that fall into the class of thermosetting polymers should function as either a cool, hot or warm peel barrier layer of the present invention. Thermosetting polymers are both chemically and physically distinct from thermoplastic polymers, which, among other properties, flow upon the addition of heat energy. The fact that the thermosetting material polymerizes to form a layer which cannot be re-melted and flow with heat energy imparts both a hot and cold peel release property. That is, the thermosetting material of the barrier layer of the present invention will not undergo a temperature dependent physical state change. Such a temperature physical state change can produce, among other properties, a tack that could provide a physical adherence of the release layer to the support base.

Thermosetting materials include thermosetting acrylic polymers and blends, such as hydroxyl-functional acrylic polymers and carboxy-functional acrylic polymers and vinyl acrylic polymer blends; thermosetting polyurethanes, block polyurethanes and aromatic-functional urethanes; thermosetting polyester polymers and co-polymer systems such as neopentyl glycol isophthalic polyester resins, dibromoneopentyl glycol polyester resins and vinyl ester resins; aromatic-functional vinyl polymers and polymer blends; and thermosetting epoxy resins, in particular, epoxy novolac resins. Generally, the thermosetting polymer system(s) must undergo crosslinking reaction(s) over a range of temperatures from, for example 100° to 250° C. over a period of less than thirty (30) minutes.

Coating weights may range from one(1) gram per meter square to 20 grams per meter square, preferably from 1 $g/m^2$ to 15 $g/m^2$, most preferably 1 $g/m^2$ to 8 $g/m^2$.

For a description of suitable thermosetting polymers, see pages 10 to 13 of *Polymer Chemistry, an Introduction*, Malcolm P. Stevens, 1990; and pages 113 and 299 of *Textbook of Polymer Science*, Fred W. Billmeyer, Jr., 1962.

The barrier layer also may optionally include an effective amount of a release-enhancing additive for assisting in release of the release layer from the barrier during peeling, such as a divalent metal ion salt of a fatty acid, a polyethylene glycol, or a mixture thereof. The release-enhancing additive may be present in an amount of from 0.1 to 40% by weight, preferably 0.1 to 20% by weight, most preferably 0.1 to 10% by weight. For example, the release-enhancing additive may be calcium stearate, a polyethylene glycol having a molecular weight of from about 2,000 to about 100,000, or a mixture thereof.

Preferably, the barrier layer is any vinyl acetate with a Tg in the range of from about −10° C. to 100° C. Alternatively, the Tg may be in the range of from about 0° C. to 100° C. EVERFLEX G, with a Tg of about −7°, may be used as a preferred embodiment.

Ultraviolet curable/setting materials may be used as the barrier layer of the present invention. UV setting materials can be divided into two classes based upon the mechanism by which they set. The first class of ultraviolet curing/setting materials set via a cationic mechanism while the second class sets via a free radical mechanism. It is important to note, however, that a number of ultraviolet curing systems incorporate both classes into a single formulation, typically termed a hybrid resin system. In one embodiment of the present invention, the ultraviolet curing system, especially when comprising cationic systems, may incorporate thermosetting polymers, thereby resulting in systems that typically are cured initially by ultraviolet activation, then further cured by exposure to a heat source. In such an embodiment, the final coated surface has the best properties of both thermosetting and ultraviolet setting systems. As a consequence of such multiple pathways to create the final cured coating, the ultraviolet setting compounds to be listed herein may be activated by any combination of the mechanisms described herein.

Furthermore, the thermosetting or UV curable barrier layer of the present invention may be combined with at least one vinyl acetate polymer. One of ordinary skill in the art would recognize the appropriate mechanism or mechanisms by which to activate a specific formulation of ultraviolet curing compounds and formulations that include both ultraviolet curing compounds and thermosetting compounds.

Typical formulations of ultraviolet curable systems are composed of primary resins, which provide the major film-forming properties; modifying resins, which modify the film properties to meet specifications for the application in which it is to be used; additives, which provide or enhance specific properties of the film; and photoinitiators which, when exposed to an ultraviolet radiation source, begin the cross-linking reaction that cures the system. The UV curable polymers of the present invention are typically cured at <50 $mJ/cm^2$ with a mercury vapor ultraviolet lamp.

Primary and modifying resins are discussed as a single class as they often cross over from one application to the next. These ultraviolet curable resins include, but are not limited to monomers and oligomers. Monomers such as monofunctional monomers including acrylates, methacrylates, and ethylacrylates; difunctional monomers including various diacrylates and dimethacrylates, especially tripropylene glycol diacrylate, bisphenol A diacrylates and ethoxylated bisphenol A dimethacrylates; trifunctional monomers including various triacrylates and trimethacrylates, especially trimethylolpropane ethoxy triacrylate and trimethyl propane triacrylates; higher functionality monomers including tetra- and pentaacrylates and pentaacrylate esters; aliphatic and aromatic acrylates; aromatic urethane acrylates; metallic acrylates; water dispersible monomers such as, for example, 2(2-ethoxyethoxy) ethylacrylate and polyethylene glycol diacrylates; adhesion promoting monomers such as various acrylate esters and methacrylate esters; pigment dispersing monomers; and scorch retarding monomers.

Oligomers such as aliphatic urethane acrylates; aliphatic urethane diacrylates; aliphatic urethane triacrylates; hexafunctional aliphatic urethane acrylates; hexafunctional aromatic urethane acrylates; trifunctional aromatic urethane acrylates, aromatic urethane acrylates; urethane methacrylates; epoxy acrylates; epoxy methacrylates; polybutadiene dimethylacrylates; diacrylates of bisphenol-A epoxy resins; modified bisphenol-A epoxy acryl ate resins; novolac epoxy acrylates; modified epoxy acrylates, partially acrylated bisphenol-A epoxy resins; bisphenol-A epoxy diacrylates; polyester resins including chlorinated polyester resins, modified polyester resins, polyester methacrylates, acrylated polyesters, modified polyester acrylates, modified polyester hexaacrylates, polyestertetracrylates, and hexafunctional polyester acrylates; cycloaliphatic epoxideresins, especially 3,4-epoxycyclohexyl-methyl-3,4,-epoxycyclohexame carboxylate; modified cycloaliphatic epoxides, especially acrylate modified cycloaliphatic epoxides containing both acrylate and epoxy functionalities; aliphatic polyols; partially acrylated bisphenol-A epoxy resins; and cycloaliphatic diepoxides.

Photoinitiators for the ultraviolet curable systems include, but are not limited to alpha hydroxy ketone; benzil dimethyl ketal; benzoin normal butyl ethers; benzophenone; modified benzophenones; polymeric hydroxy ketones; trimethylbenzophenone blends; sulfonium, iodonium, ferrocenium or diazonium salts, especially cyclic 1,2-propylene carbonate bis-p-diphenylsulfoniumphenylsulfide hexafluorophosphate, and diphenylsulfonium hexafluorophosphate; peroxides; cobaloximes and related cobalt (II) complexes; and organic photoinitiators such as, for example, 2,2-diethoxyacetophenone, ethyl 4-(dimethylamino) benzoate, methyldiethanolamine, isopropylthioxanthone, and especially 2-hydroxy-2-methyl-1-phenyl-1-propanone.

Additives that may be used in the above-described ultraviolet curable systems include, but are not limited to photoinitiator activators; slip agents; leveling agents; wetting agents; adhesion promoters; anti-absorption agents; anti-foaming agents, especially mixtures of foam destroying polymers and polysiloxanes; accelerators; pigment dispersion aids; anti-blocking agents; anti-caking agents; anti-slip agents; anti-skinning agents; anti-static agents; anti-stripping agents; binders; curing agents; crosslinking agents; deaerators; diluents; dispersants; dryers; emulsifiers; fillers; flatting agents; flow control agents; gloss agents; hardeners; lubricants; mar resistance aids; whiteners; plasticizers; solvents; stabilizers; surfactants; viscosity modifiers; UV stabilizers; UV absorbers; and water repellants. The barrier layer of the present invention may also comprise the cross-linking polymers of U.S. Pat. No. 5,603,996 to Overcash et al. Specifically, see Overcash et al. at cols. 5–8.

The barrier layer may comprise an acrylic polymer, or resin, as a cross-linkable polymer. Additional cross-linkable acrylic polymers include MICHEM COAT 50A, made by Michelman, Inc., and RHOPLEX.RTM. P-376 and RHOPLEX.RTM. B-15, made by Rohm and Haas. In addition, styrene-butadiene resins, or polymers, ("SBR") are suitable as cross-linkable polymers in the barrier coating composition, including such SBR's as MICHEM COAT 50H, made by Michelman, Inc., and Latex PB 6692NA made by Dow Chemical. Blends and/or copolymers of cross-linkable polymers may also be used. Other cross-linkable polymers, such as polyurethane polymers and various fluorochemical polymers (e.g., 3B ZONYL.RTM. 7040 made by Du Pont), may also provide the necessary barrier properties. Additionally, EvCote PWR-25 by Evco, is a suitable heat crosslinked barrier layer.

A more specific listing of polymers that may be used as cross-linkable polymers includes, but is not limited to:

polymers and copolymers of poly(dienes) such as poly (butadiene), poly(isoprene), and poly(1-penetenylene);

poly(acrylics) such as poly(benzyl acrylate), poly(butyl acrylate) (s), poly(2-cyanobutyl acrylate), poly(2-ethoxyethyl acrylate), poly(ethyl acrylate), poly(2-ethylhexyl acrylate), poly(fluoromethyl acrylate), poly(5,5,6,6,7,7,7-heptafluoro-3-oxaheptyl acrylate), poly (heptafluoro-2-propyl acrylate), poly(heptyl acrylate), poly(hexyl acrylate), poly(isobomyl acrylate), poly (isopropyl acrylate), poly(3-methoxybutyl acrylate), poly (methyl acrylate), poly(nonyl acrylate), poly(octyl acrylate), poly(propyl acrylate), and poly(p-tolyl acrylate);

poly(acrylamides) such as poly(acrylamide), poly(N-butylacrylamide), poly(N,N-dibutylacrylamide), poly(N-dodecylacrylamide), and poly(morpholylacrylamide);

poly(methacrylic acids) and poly(methacrylic acid esters) such as poly(benzyl methacrylate), poly(octyl methacrylate), poly(butyl methacrylate), poly(2-chloroethyl methacrylate), poly(2-cyanoethyl methacrylate), poly(dodecyl methacrylate), poly(2-ethylhexyl methacrylate), poly(ethyl methacrylate), poly (1,1,1-trifluoro-2-propyl methacrylate), poly(hexyl methacrylate), poly(2-hydroxyethyl methacrylate), poly (2-hydropropyl methacrylate), poly(isopropyl methacrylate), poly(methacrylic acid), poly(methyl methacrylate) in various forms such as, atactic, isotactic, syndiotactic, and heterotactic; and poly(propyl methacrylate);

poly(methacrylamides) such as poly(4-carboxy phenylmethacrylamide);

other alpha-and beta-substituted poly(acrylics) and poly (methacrylics) such as poly(butyl chloracrylate), poly (ethyl ethoxycarbonylmethacrylate), poly(methyl fluoroacrylate), and poly(methyl phenylacrylate);

poly(vinyl ethers) such as poly(butoxyethylene), poly (ethoxyethylene), poly(ethylthioethylene), (dodecafluorobutoxyethylene), poly poly(2,2,2-trifluoroethoxytrifluoroethylene), poly (hexyloxyethylene), poly(methoxyethylene), and poly(2-methoxypropylene);

poly(vinyl halides) and poly(vinyl nitriles) such as poly (acrylonitrile), poly(1,1-dichloroethylene), poly (chlorotrifluoroethylene), poly(1,1-dichloro-2-fluoroethylene), poly(1,1-difluoroethylene), poly (methacrylonitrile), poly(vinyl chloride), and poly (vinylidene chloride);

poly(vinyl esters) such as poly(vinyl acetate), poly (benzoyloxyethylene), poly(4-butyryloxybenzoyloxyethylene), poly(4-ethylbenzoyloxyethylene), poly[(trifluoroacetoxy) ethylene], poly[(heptafluorobutyryloxy)ethylene], poly (formyloxyethylene), poly[(2-methoxybenzoyloxy) ethylene], poly(pivaloyloxyethylene), and poly (propionyloxyethylene);

poly(styrenes) such as, poly(4-acetylstyrene), poly[3-(4-biphenylyl)styrene], poly(4-[(2-butoxyethoxy) methyl] styrene), poly(4-butoxymethyl styrene), poly(4-butoxystyrene), poly(4-butylstyrene), poly(4-chloro-2-methylstyrene), poly(2-chlorostyrene), poly(2,4-dichlorostyrene), poly(2-ethoxymethyl styrene), poly(4-ethoxystyrene), poly(3-ethylstyrene), poly(4-fluorostyrene), poly(perfluorostyrene), poly(4-hexylstyrene), poly [4-(2-hydroxyethoxymethyl)styrene], poly[4-(1-hydroxy-1-methylpropyl)styrene], poly(2-methoxymethylstyrene), poly(2-methoxystyrene), poly (alpha-methylstyrene), poly(2-methylstyrene), poly(4-methoxystyrene), poly(4-octanoylstyrene), poly(4-phenoxystyrene), poly(4-phenylstyrene), poly(4-propoxystyrene), and poly(styrene);

poly(oxides) such as poly(ethylene oxides), poly (tetrahydrofuran), poly(oxetanes), poly(oxybutadiene), poly[oxychloromethyl)ethylene], poly(oxy-2-hydroxytrimethyleneoxy-1,4-phenylenemethylene-1,4-phenylene), poly(oxy-2,6-dimethoxy-1,4-phenylene), and poly(oxy-1,3-phenylene);

poly(carbonates) such as polycarbonate of Bisphenol A, and poly[oxycarbonyloxy-4,6-dimethyl]-1,2-phenylenemethylene-3,5-dimethyl-1,2-phenylene];

poly(esters) such as poly(ethylene terephthalate), poly[(1,2-diethoxycarbonyl)ethylene], poly[(1,2-dimethoxycarbonyl)ethylene], poly(oxy-2-butenyleneoxysebacoyl), poly[di(oxyethylene) oxyadipoyl], poly(oxyethyleneoxycarbonyl-1,4-cyclohexylenecarbonyl), poly (oxyethyleneoxyisophthaloyl), poly[di(oxyethylene) oxyoxalyl], poly[di(oxyethylene)oxysuccinyl], poly (oxyethyleneoxyterephthaloyl), poly(oxy-1,4-phenyleneisopropyiidene-1,4-phenylene oxysebacoyl), and poly(oxy-1,3-phenyleneoxyisophthaloyl);

poly(anhydrides) such as poly(oxycarbonyl-1,4-phenylenemethylene-1,4-phenyl enecarbonyl), and poly (oxyisophthaloyl);

poly(urethanes) such as poly (oxycarbonyliminohexa methyleneiminocarbonyloxydecamethylene), poly (oxyethyleneoxycarbonyliminiohexamethyleneiminocarbonyl), poly(oxyethyleneoxycarbonylimino-1,4-phenylenetrimethylene-1,4-phenyleneim inocarbonyl), poly(oxydodecamethyleneoxycarbonyliminodeca methyleneiminocarbonyl), and poly (oxytetramethyleneoxycarbonylimino-1,4-phenylenemethylene-1,4-phenyleneiminocarbonyl);

poly(siloxanes) such as, poly(dimethylsiloxane), poly[oxy(methyl)phenylsilylene], and poly(oxydiphenylsilylene-1,3-phenylene);

poly(sulfones) and poly(sulfonamides) such as poly[oxycarbonyl di(oxy-1,4-phenylene)sulfonyl-1,4-phenyleneoxy-1,4-phenylene], poly[oxy-1,4-phenylenesulfinyl-1,4-phenyleneoxy-1,4-phenylenecarbonyl-1,4-phenylene), poly(oxy-1,4-phenylenesulfonyl-1,4-phenylene), and poly(sulfonyl-1,3-cyclohexylene);

poly(amides) such as nylon-6, nylon-6,6, nylon-3, nylon-4,6, nylon-5,6, nylon-6,3, nylon-6,2, nylon-6,12, and nylon-12;

poly(imines) such as poly(acetyliminoethylene), and poly(valeryl iminoethylene);

poly(benzimidazoles) such as poly(2,6-benzimidazolediyl-6,2-benzimidazolediyloctamethylene);

carbohydrates such as amylose triacetate, cellulose triacetate, cellulose tridecanoate, ethyl cellulose, and methylcellulose;

and polymer mixtures and copolymers thereof such as poly(acrylonitrile-co-styrene) with poly(e-caprolactone), or poly(ethyl methacrylate), or poly(methyl methacrylate);

poly(acrylonitrile-co-vinylidene chloride) with poly(hexamethylene terephthalate);

poly(allyl alcohol-co-styrene) with poly(butylene adipate), or poly(butylene sebacate); poly(n-amyl methacrylate) with poly(vinyl chloride);

bisphenol A polycarbonate with poly(e-caprolactone), or poly(ethylene adipate), or poly(ethylene terephthalate), or novolac resin;

poly(butadiene) with poly(isoprene);

poly(butadiene-co-styrene) with glycerol ester of hydrogenated rosin;

poly(butyl acrylate) with poly(chlorinated ethylene), or poly(vinyl chloride);

poly(butyl acrylate-co-methyl methacrylate) with poly(vinyl chloride);

poly(butyl methacrylate) with poly(vinyl chloride);

poly(butylene terephthalate) with poly(ethylene terephthalate), or poly(vinyl acetate-co-vinylidene chloride);

poly(e-caprolactone) with poly(chlorostyrene), or poly(vinyl acetate-co-vinylidene chloride);

cellulose acetate with poly(vinylidene chloride-co-styrene);

cellulose acetate-butyrate with poly(ethylene-co-vinyl acetate);

poly(chlorinated ethylene) with poly(methyl methacrylate);

poly(chlorinated vinyl chloride) with poly(n-butyl methacrylate), or poly(ethyl methacrylate), or poly(valerolactone);

poly(chloroprene) with poly(ethylene-co-methyl acrylate);

poly(2,6-dimethyl-1,4-phenylene oxide) with poly(a-methylstyrene-co-styrene styrene), or poly(styrene);

poly(ethyl acrylate) with poly(vinyl chloride-co-vinylidene chloride), or poly(vinyl chloride);

poly(ethyl methacrylate) with poly(vinyl chloride);

poly(ethylene oxide) with poly(methyl methacrylate);

poly(styrene) with poly(vinyl methyl ether); and poly(valerolactone) with poly(vinyl acetate-co-vinylidene chloride).

Another suitable barrier layer may be the release layer of U.S. Pat. No. 5,798,179 to Kronzer. The barrier layer may be composed of a thermoplastic polymer having essentially no tack at transfer temperatures (e.g., 60–220° C.), a solubility parameter of at least about 19 $(Mpa)^{1/2}$, and a glass transition temperature of at least about 0° C. As used herein, the phrase "having essentially no tack at transfer temperatures" means that the barrier layer does not stick to the polyester layer to an extent sufficient to adversely affect the quality of the transferred image. By way of illustration, the thermoplastic polymer may be a hard acrylic polymer or poly(vinyl acetate). For example, the thermoplastic polymer may have a glass transition temperature ($T_g$) of at least about 25° C. As another example, the $T_g$ may be in a range of from about 25° C. to about 100° C. The barrier layer also may include an effective amount of a release-enhancing additive, such as a divalent metal ion salt of a fatty acid, a polyethylene glycol, or a mixture thereof. For example, the release-enhancing additive may be calcium stearate, a polyethylene glycol having a molecular weight of from about 2,000 to about 100,000, or a mixture thereof.

Additionally, there are no primary or secondary changes of state upon heating that would alter the physical characteristics (such as, for example, surface residue) upon transfer. The barrier layer of the present invention preferably transfers no residue to the transferred image. The barrier layer preferably provides a water barrier that helps prevent penetration of the support.

In a preferred embodiment of the invention, the barrier layer is a vinyl acetate polymer. In another embodiment of the present invention, the barrier layer contains a polyester resin such as polymethyl methacrylate (PMMA) in a molecular weight range of from 15,000 to 120,000 Daltons.

The barrier layer may possess hot, warm and cold peel properties, such as when EVERFLEX G is used as part of the barrier layer. That is, after heat is applied to the transfer sheet and the image is transferred to the receptor, the transfer sheet may be peeled away from the receptor immediately after ironing (hot peel), before it is allowed to cool (i.e., warm peel), or alternatively, the transfer sheet is allowed to cool before it is peeled away from the receptor (i.e., cold peel).

By way of example, the barrier layer may comprise the following polymers which have suitable glass transition temperatures as disclosed in U.S. Pat. No. 5,798,179 to Kronzer:

| Polymer Type | Product Identification |
|---|---|
| Polyacrylates | Hycar ® 26083, 26084, 26120, 26104, 26106, 26322, B. F. Goodrich Company, Cleveland, Ohio<br>Rhoplex ® HA-8, HA-12, NW-1715, Rohm and Haas Company, Philadelphia, Pennsylvania<br>Carboset ® XL-52, B. F. Goodrich Company, Cleveland, Ohio |
| Styrene-butadiene copolymers | Butofan ® 4264, BASF Corporation, Sarnia, Ontario, Canada DL-219, DL-283, Dow Chemical Company, Midland, Michigan |
| Ethylene-vinyl acetate copolymers | Dur-O-Set ® E-666, B-646, E-669, National Starch & Chemical Co., Bridgewater, New Jersey |
| Nitrile rubbers | Hycar ® 1572, 1577, 1570 × 55, B. F. Goodrich Company, Cleveland, Ohio |
| Poly(vinyl chloride) | Vycar ® 352, B. F. Goodrich Company, Cleveland, Ohio |
| Poly (vinyl acetate) | Vinac XX-210, Air Products and Chemicals, Inc., Napierville, Illinois |
| Ethylene-acrylate copolymers | Michem ® Prime, 4990, Michelman, Inc., Cincinnati, Ohio Adcote 56220, Morton Thiokol, Inc., Chicago, Illinois |

An additional embodiment of the barrier layer of the present invention is 100 parts (by weight) Polyester Resin (Polylite 32-737; Reichhold, Inc.). The polyester coating is applied with a dry coat weight of from 1 to 20 g/m$^2$, preferably 1–15 g/m$^2$ and most preferably 1–8 g/m$^2$. Coating methods include gravure, metered rod, air knife, cascade, etc. Coatings are cured by exposure to thermal energy that ranges from 30° C. to 250° C., preferably 70° C. to 200° C., and most preferably 120° to 170° C. Curing times range from 10 seconds to 20 minutes, preferably from 1 minute to 18 minutes, most preferably from 8 minutes to 15 minutes.

In one embodiment of the present invention, where the image is peeled from the support prior to transfer, a barrier layer may not be necessary. For example, when the support is a polyester film base, such as polyacetate, there will be minimal adherence to the support by the pressure sensitive adhesive layer and/or the heat sealing material. Accordingly, in those instances, a barrier layer may not be required.

In another embodiment of the present invention, where the image is peeled from the support prior to transfer, the barrier layer described in U.S. application Ser. No. 09/637,082 may be employed. This barrier layer comprises: (1) a vinyl acetate with a Tg in the range of −10° C. to 100° C.; (2) a thermoplastic polymer having essentially no tack at transfer temperatures, a solubility parameter of at least 19 (Mpa)$^{1/2}$, and a glass transition temperature of at least 0° C., or (3) thermosetting polymers, ultraviolet curing polymers, or combinations thereof. If a barrier layer such as the above three alternatives is used, a PSA may not be needed. That is, the barrier layer may perform the function of the PSA.

Other examples of a suitable barrier layer(s) of the present invention may be the release layer of U.S. Pat. No. 5,798,179 to Kronzer. The barrier layer may be composed of a thermoplastic polymer having essentially no tack at transfer temperatures (e.g., 177° C.), a solubility parameter of at least about 19 (Mpa)$^{1/2}$, and a glass transition temperature of at least about 0° C. As used herein, the phrase "having essentially no tack at transfer temperatures" means that the barrier layer does not stick to the Release Layer to an extent sufficient to adversely affect the quality of the transferred image. By way of illustration, the thermoplastic polymer may be a hard acrylic polymer or poly(vinyl acetate). For example, the thermoplastic polymer may have a glass transition temperature ($T_g$) of at least about 25° C. As another example, the $T_g$ may be in a range of from about 25° C. to about 100° C. The barrier layer also may include an effective amount of a release-enhancing additive, such as a divalent metal ion salt of a fatty acid, a polyethylene glycol, or a mixture thereof. For example, the release-enhancing additive may be calcium stearate, a polyethylene glycol having a molecular weight of from about 2,000 to about 100,000, or a mixture thereof.

In one embodiment of the invention, Barrier Layer Formulation 1, the barrier layer comprises a vinyl acetate polymer. Barrier Layer Formulation 1 may be prepared as described in Provisional application 60/127,625. In another embodiment of the present invention, the barrier layer contains a polyester resin such as polymethyl methacrylate (PMMA) in a molecular weight range of from 15,000 to 120,000 Daltons. Barrier Layer Formulation 2 may be prepared as described in Provisional application 60/127,625. Furthermore, the barrier layer(s) of the present invention may comprise the thermosetting polymers, ultraviolet curing polymers, or combinations thereof as described in Provisional application 60/133,861.

3. Optional Pressure Sensitive Adhesion Layer

In accordance with one embodiment of the invention, for instance as discussed in U.S. application Ser. Nos. 09/637,082, 09/672,827, and U.S. Pat. No. 6,087,061, the present invention relates to a greeting card which incorporates a polymeric transfer sheet that can be marked and transferred by the consumer. This transfer sheet comprises a base or support, in which the support is coated with a lightly tacky pressure sensitive adhesive layer (PSA). The PSA layer may be any polyester or acrylic polymer or copolymer blend or rubbery contact adhesive and preferably has a glass transition temperature (Tg) of less than zero degrees Centigrade.

The PSA layer allows the layers of the heat-setting label sheet to be easily separated by peeling from the support. If an above-described barrier layer accomplishes this task, the pressure sensitive adhesive layer may be optional.

Generally, the PSA layer remains with the support, along with the barrier layer. However, any portion of the PSA layer that is peeled away with the remaining layers of the label helps to provide stickiness used to adhere the label to the receptor. That is, the PSA layer allows the label to be laid onto the receptor and repositioned multiple times with a slight tack. However, the PSA layer does not provide for permanent adhesion to the receptor.

Any polyester or acrylic polymer or copolymer blends may be used when the glass transition temperature (Tg) of the polyester, acrylic polymer or copolymer blend is less than zero degrees Centigrade. Preferably, the Tg will fall between −15° C. and −70° C. and display a slight tack when touched.

A preferred example of the pressure sensitive adhesive layer, Pressure Sensitive Adhesive Layer Formulation 1, is comprised of an acrylic polymer adhesive.

Preferably, the PSA has a thickness of about 0.4 mils (wet).

When the optional PSA layer is not used, but the present embodiment of peeling the image prior to transfer is desired, the surface energy difference between the selected barrier layer and the Release Layer, described below, must be between about 0 to about 50 dynes/cm, preferably about 0 to about 30 dynes/cm, most preferably about 0 to about 15 dynes/em.

4. Optional Antistatic Layer

In accordance with one embodiment of the invention, the support is usable in a laser copier or laser printer. A preferred support for this embodiment is equal to or less than approximately 4.0 mils thick. The antistatic layer according to the present invention may have a solution viscosity of from 0.1 to 20 cP, preferably 1–5 cP, most preferably about 2 cP, as measured on a Brookfield DV-I+ viscometer, LV1 spindle at 60 rpm at a temperature of 25° C. Additionally, the antistatic layer may be wet coated in an amount of from 1 g/m$^2$ to 50 g/m$^2$, preferably from 10–30 g/m$^2$, most preferably about 18 g/m$^2$. The surface tension of the antistatic layer may be from 30–110 dynes/cm, preferably from 50–90 dynes/cm, most preferably about 70 dynes/cm as measured at room temperature.

Since this particular support is useable in a laser copier or laser printer, antistatic agents may be present. The antistatic agents may be present in the form of a coating on the back surface of the support as an additional layer. The back surface of the support is the surface that is not previously coated with the release layer, optional barrier layer, etc.

When the antistatic agent is applied as a coating onto the back surface of the support, the coating will help eliminate copier or printer jamming by preventing the electrostatic adhesion of the paper base to the copier drum of laser and electrostatic copiers and printers. Antistatic agents, or "antistats" are generally, but not necessarily, conductive polymers that promote the flow of charge away from the paper. Antistats can also be "humectants" that modulate the level of moisture in a paper coating that affects the build up of charge. Antistats are commonly charged tallow ammonium compounds and complexes, but also can be complexed organometallics. Antistats may also be charged polymers that have a similar charge polarity as the copier/printer drum; whereby the like charge repulsion helps prevent jamming.

Antistatic agents include, by way of illustration, derivatives of propylene glycol, ethylene oxide-propylene oxide block copolymers, organometallic complexes such as titanium dimethylacrylate oxyacetate, polyoxyethylene oxide-polyoxypropylene oxide copolymers and derivatives of cholic acid.

More specifically, commonly used antistats include those listed in the *Handbook of Paint and Coating Raw Materials*, such as t-Butylaminoethyl methacrylate; Capryl hydroxyethyl imidazoline; Cetethyl morpholinium ethosulfate; Cocoyl hydroxyethyl imidazoline Di(butyl, methyl pyrophosphato) ethylenetitanate di(dioctyl, hydrogen phosphite); Dicyclo(dioctyl)pyrophosphato; titanate; Di(dioctylphosphato) ethylene titanate; Dimethyl diallyl ammonium chloride; Distearyldimonium chloride; N,N'-Ethylene bis-ricinoleamide; Glyceryl mono/dioleate; Glyceryl oleate; Glyceryl stearate; Heptadecenyl hydroxyethyl imidazoline; Hexyl phosphate; N(β-Hydroxyethyl) ricinoleamide; N-(2-Hydroxypropyl) benzenesulfonamide; Isopropyl4-aminobenzenesulfonyl di(dodecylbenzenesulfonyl)titanate; Isopropyl dimethacryl isostearoyl titanate; isopropyltri(dioctylphosphato)titanate; Isopropyl tri(dioctylpyrophosphato)titanate; Isopropyl tri(N ethylaminoethylamino)titanate; (3-Lauramidopropyl) trimethyl ammonium methyl sulfate; Nonyl nonoxynol-15; Oleyl hydroxyethylimidazoline; Palmitic/stearie acid mono/diglycerides; PCA; PEG-36 castor oil; PEG-10 cocamine; PEG-2 laurate; PEG-2; tallowamine; PEG-5 tallowamine; PEG-15 tallowamine; PEG-20 tallowamine; Poloxamer 101; Poloxamer 108; Poloxamer 123; Poloxamer 124; Poloxamer 181; Poloxamer 182; Polaxamer 184; Poloxamer 185; Poloxamer 188; Poloxamer 217; Poloxamer 231; Poloxamer 234; Poloxamer 235; Poloxamer 237; Poloxamer 282; Poloxamer 288; Poloxamer 331; Polaxamer 333; Poloxamer 334; Poloxamer 335; Poloxamer 338; Poloxamer 401; Poloxamer 402; Poloxamer 403; Poloxamer 407; Poloxamine 304; Poloxamine 701; Poloxamine 704; Polaxamine 901; Poloxamine 904; Poloxamine 908; Poloxamine 1107; Poloxamine 1307; Polyamide/epichlorohydrin polymer; Polyglyceryl-10 tetraoleate; Propylene glycol laurate; Propylene glycol myristate; PVM/MA copolymer; polyether; Quaternium-18; Slearamidopropyl dimethyl-β-hydroxyethyl ammonium dihydrogen phosphate; Stearamidopropyl dimethyl-2-hydroxyethyl ammonium nitrate; Sulfated peanut oil; Tetra(2, diallyoxymethyl-1 butoxy titanium di(di-tridecyl)phosphite; Tetrahydroxypropyl ethylenediamine; Tetraisopropyl di(dioctylphosphito)titanate; Tetraoctyloxytitanium di(ditridecylphosphite); Titanium di(butyl, octyl pyrophosphate) di(dioctyl, hydrogen phosphite) oxyacetate; Titanium di(cumylphenylate)oxyacetate; Titanium di(dioctylpyrophosphate)oxyacetate; Titanium dimethacrylate oxyacetate.

Preferably, Marklear AFL-23 or Markstat AL-14, polyethers available from Whitco Industries, are used as an antistatic agents.

The antistatic coating may be applied on the back surface of the support by, for example, spreading a solution comprising an antistatic agent (i.e., with a metering rod) onto the back surface of the support and then drying the support.

An example of one support of the present invention is Georgia Pacific brand Microprint Laser Paper. However, any non-woven cellulosic or film support may be used as the support in the present invention.

5. The Release Layer

The release layer (also herein referred to as the transfer layer) is applied over the support or over the optional barrier layer. The release layer according to the present invention may have a solution viscosity of from 20 to 170 cP, preferably 70–150 cP, most preferably about 100–130 cP, as measured on a Brookfield DV-I+viscometer, LV1 spindle at 60 rpm at a temperature of 30° C. Additionally, the release layer may be wet coated in an amount of from 50 g/m$^2$ to 150 g/m$^2$, preferably from 80–120 g/m$^2$, most preferably about 100 g/m$^2$. The surface tension of the release layer may be from 25–65 dynes/cm, preferably from 35–55 dynes/cm, most preferably about 45 dynes/cm as measured at room temperature.

The release layer of the present invention facilitates the transfer of the image from the support to the receptor. That is, the release layer of the present invention must provide the properties to effectively transfer the release layer, the image receiving layer and any images and/or optional layers thereon. Further, the release layer must also provide for adhesion of the release layer and the image area to the receptor without the requirement of a separate surface adhesive layer.

The release layer of the present invention may be prepared from, for example, a coating composition comprising an acrylic dispersion, an elastomeric emulsion, a plasticizer, and a water repellant.

The release layer of the present invention protects any transferred image, provides mechanical and thermal stability, as well as washability, preferably without losing the flexibility of the textile. That is, the release layer should also provide a colorfast image (e.g. washproof or wash resistant) when transferred to the receptor surface. Thus, upon washing the receptor element (e.g. tee shirt), the image should remain intact on the receptor.

According to the present invention, the heat release layer may be a single layer or a plurality of heat release layers. Suitable materials for the heat release layer include polyvinylchloride plastisols which are dispersions of a vinyl resin in a non-aqueous liquid. Suitable plastisols, their preparation and application as heat release layers are described, for example, in U.S. Pat. No. 4,037,008. The heat release layer may also be a wax layer having a melting point lower than the barrier coating layer on the support sheet, if a barrier layer is present. Heat application to the transfer sheet melts the wax release layer allowing separation of the release layer from the backing sheet. Such wax release layers may be applied to the support sheet using an offset role as described in U.S. Pat. No. 4,322,467. The heat release layer described in U.S. Pat. No. 4,117,182 which contains an acrylic resin or cellulosic derivative, preferably in combination with a straight chain, primary aliphatic oxyalkylated alcohol, a plasticizer and a tackifier may also be used.

In one embodiment, the heat release layer is a two layer structure in which the first layer on top of said optional barrier layer or in contact with the support is a mixture of a vinyl resin and a polyethylene wax, and the second layer in contact with first layer is an ionomer polymer applied as a latex. The first layer is formed by heating the vinyl resin and wax and a solvent, such as toluene or a diluent such as odorless mineral spirits at a weight ratio of 70% solids to 30% solids, until the mixture is homogenous. When toluene is used, the mixture should be brought to a preferred temperature of from 82.2° C. to 96° C. in order to cause the resin to dissolve and liquefy. Suitable vinyl resins are copolymers of vinyl acetate and ethylene containing about 17–33% by weight vinyl acetate and having a melt index (as measured by ASTM D1238) of from 5 to 46.5. Suitable vinyl resins will have a resin density of about 0.933 to about 0.954 $gm/cm^3$ and a ring and ball softening point as measured by ASTM E28 of about 180° F. to 310° F. Suitable vinyl resins are commercially available as EVA 501 and EVA 505 from Union Carbide Corporation. The vinyl resin/wax mixture will generally contain 100–40 parts by weight vinyl resin and 20–80 parts wax.

Suitable polyethylene waxes are polyethylene waxes having a weight average molecular weight from about 1800 to 8000, a ring and ball softening point from about 100° C. to 120° C., a density from about 0.906–0.964 $gm/cm^3$ at 25° C. and a viscosity from about 230–1800 cP as measured by Brookfield Viscosity, No. 3 Spindle at 60 rpm. The polyethylene waxes may be either emulsifiable or non-emulsifiable. A suitable polyethylene wax is available as EPOLENE E14 from Eastman Chemical Products of Kingsport, Tenn.

The vinyl resin and polyethylene wax are blended together in heated solvent to form a hot clear solution which is uniformly applied over the support sheet using any conventional coating method such as an air knife, gravure roller or wire rod applicator. The first layer is preferably applied at about 3–10 lbs. per 1300 $ft^2$.

The second layer of ionomer polymer is applied over the first layer, preferably as a latex containing about 30% by weight polymer and 80% by weight water. Suitable ionomer dispersions are commercially available as 56220 SURLYN, 56230 SURLYN and 56256 SURLYN from E. I. DuPont. Ethylene-acrylic acid copolymers having an acrylic acid content of about 17–20% by weight and a melt index of from about 300 to 500 may also be used as the ionomer polymer. If it is desired to extrude the second layer onto the first layer, and ethylene-acrylic acid copolymer containing about 3–15% by weight acrylic acid and having a melt index of about 2–11 can be used. The second layer is preferably applied at a rate of about 1–4 lbs per 1300 $ft^2$.

This type of heat release layer is fully described in U.S. Pat. No. 4,235,657. A suitable support sheet having disposed thereon one or more heat release layers is commercially available as ULTIMA from Kimberly-Clark Company.

Further, the release layer of the present invention satisfies the requirement for compatible components, in that the component dispersions remain in their finely dispersed state after admixture, without coagulating or forming clumps or aggregated particles which would adversely affect image quality. Additionally, the release layer is preferably non-yellowing.

The above-described release layers all have a high content of organic solvent. However, release layers which have a low content of organic solvent are also embodied by the present invention. In connection with the present invention, release layers having a low organic solvent content are preferred.

Thus, in one embodiment of the present invention, the release layer has a low content of organic solvents, and any small amounts present during the coating process are sufficiently low as to meet environmental and health requirements. More specifically, the release layer preferably has a content of organic solvents of less than 2% weight by weight of components. More preferably, the release layer has a content of organic solvents of less than 1% weight by weight of components.

Particularly when the method for applying the image area is a laser printer or copier, the release layer of the present invention preferably excludes wax dispersions derived from, for example, a group including but not limited to natural waxes such as camauba wax, mineral waxes, montan wax, derivatives of montan wax, petroleum waxes, and synthetic waxes such as polyethylene and oxidized polyethylene waxes. If the imaging method used is a non-laser printer/copier method, waxes are not excluded from use in the transfer material. However, the amount of waxes that may be present in the transfer material of the invention when intended for use in laser printers or copiers must be sufficiently low as to avoid adverse affects on copier or printer operation. That is, the amount of wax present must not cause melting in the printer or copier.

The above properties make this release layer highly suited for making compatible the stringent requirements of the electrostatic imaging process with the requirements of heat transfer image technology to provide a product having good image quality and permanence under the demanding conditions of textile application, wear and wash resistance in use, and adhesion to wash resistance on decorated articles. The release layer is preferably a polymeric coating designed to provide a release from the support and adherence to a receptor when heat is applied to the back of the support.

The term "melts" and variations thereof are used herein only in a qualitative sense and are not meant to refer to any particular test procedure. Reference herein to a melting temperature or range is meant only to indicate an approximate temperature or range at which a polymer or binder melts and flows under the conditions of a melt-transfer process to result in a substantially smooth film.

Manufacturers' published data regarding the melt behavior of polymers or binders correlate with the melting requirements described herein. It should be noted, however, that either a true melting point or a softening point may be given, depending on the nature of the material. For example, materials such as polyolefins and waxes, being composed mainly of linear polymeric molecules, generally melt over a relatively narrow temperature range since they are somewhat crystalline below the melting point.

Melting points, if not provided by the manufacturer, are readily determined by known methods such as differential scanning calorimetry. Many polymers, and especially copolymers, are amorphous because of branching in the polymer chains or the side-chain constituents. These materials begin to soften and flow more gradually as the temperature is increased. It is believed that the ring and ball softening point of such materials, as determined by ASTM E-28, is useful in predicting their behavior. Moreover, the melting points or softening points described are better indicators of performance than the chemical nature of the polymer or binder.

Representative binders (i.e., acrylic dispersions) for release from the support are as follows:

Binder A

Binder A is Michem® 58035, supplied by Michelman, Inc., Cincinnati, Ohio. This is a 35 percent solids dispersion of Allied Chemical's AC580, which is approximately 10 percent acrylic acid and 90 percent ethylene. The polymer reportedly has a softening point of 102° C. and a Brookfield viscosity of 0.65 pas (650 centipoise) at 140° C.

Binder B

This binder is Michem® Prime 4983R (Michelman, Inc., Cincinnati, Ohio). The binder is a 25 percent solids dispersion of Primacor® 5983 made by Dow Chemical Company. The polymer contains 20 percent acrylic acid and 80 percent ethylene. The copolymer has a Vicat softening point of 43° C. and a ring and ball softening point of 100° C. The melt index of the copolymer is 500 g/10 minutes (determined in accordance with ASTM D-1238).

Binder C

Binder C is Michem® 4990 (Michelman, Inc., Cincinnati, Ohio). The material is 35 percent solids dispersion of Primacor® 5990 made by Dow Chemical Company. Primacor® 5990 is a copolymer of 20 percent acrylic acid and 80 percent ethylene. It is similar to Primacor® 5983 (see Binder B), except that the ring and ball softening point is 93° C. The copolymer has a melt index of 1,300 g/10 minutes and Vicat softening point of 39° C.

Binder D

This binder is Michem® 37140, a 40 percent solids dispersion of a Hoechst-Celanese high density polyethylene. The polymer is reported to have a melting point of 100° C.

Binder E

This binder is Michem® 32535 which is an emulsion of Allied Chemical Company's AC-325, a high density polyethylene. The melting point of the polymer is about 138° C. Michem® 32535 is supplied by Michelman, Inc., Cincinnati, Ohio.

Binder F

Binder F is Michem® 48040, an emulsion of an Eastman Chemical Company microcrystalline wax having a melting point of 88° C. The supplier is Michelman, Inc., Cincinnati, Ohio.

Binder G

Binder G is Michem® 73635M, an emulsion of an oxidized ethylene-based polymer. The melting point of the polymer is about 96° C. The hardness is about 4–6 Shore-D. The material is supplied by Michelman Inc., Cincinnati, Ohio.

In one embodiment of the invention, the release layer comprises an ethylene acrylic acid co-polymer dispersion, an elastomeric emulsion, a polyurethane dispersion, and polyethylene glycol.

The acrylic dispersion is present in a sufficient amount so as to provide adhesion of the release layer and image to the receptor element and is preferably present in an amount of from 46 to 90 weight %, more preferably 70 to 90 weight % based on the total composition of the release layer. Preferably, the acrylic dispersion is an ethylene acrylic acid co-polymer dispersion that is a film-forming binder that provides the "release" or "separation" from the substrate. The release layer of the invention may utilize the film-forming binders of the image-receptive melt-transfer film layer of U.S. Pat. No. 5,242,739, which is herein incorporated by reference.

The nature of the film-forming binder is not known to be critical. That is, any film-forming binder can be employed so long as it meets the criteria specified herein. As a practical matter, water-dispersible ethylene-acrylic acid copolymers have been found to be especially effective film forming binders.

The elastomeric emulsion provides the elastomeric properties such as mechanical stability, flexibility and stretchability, and is preferably present in an amount of from 1 to 45 weight %, more preferably 1 to 20 weight % based on the total composition of the release layer.

The plasticizer provides plasticity and antistatic properties to the transferred image, and is preferably present in an amount of from 1 to 8 weight %, more preferably 2 to 7 weight % based on the total composition of the release layer.

Another component of the release layer is an elastomeric emulsion, preferably a latex, and is compatible with the other components, and formulated to provide durability, mechanical stability, and a degree of softness and conformability to the layers.

Films of this material must have moisture resistance, low tack, durability, flexibility and softness, but with relative toughness and tensile strength. Further, the material should have inherent heat and light stability. The latex can be heat sensitized, and the elastomer can be self-crosslinking or used with compatible cross-linking agents, or both. The latex should be sprayable, or roll stable for continuous runnability on nip rollers.

Elastomeric latexes of the preferred type are produced from the materials and processes set forth in U.S. Pat. Nos. 4,956,434 and 5,143,971, which are herein incorporated by reference. This curable latex is derived from a major amount of acrylate monomers such as $C_4$ to $C_8$ alkyl acrylate, preferably n-butyl acrylate, up to about 20 parts per hundred of total monomers of a monolefinically unsaturated dicarboxylic acid, most preferably itaconic acid, a small amount of crosslinking agent, preferably N-methyl acrylamide, and optionally another monolefinic monomer.

Using a modified semibatch process in which preferably the itaconic acid is fully charged initially to the reactor with the remaining monomers added over time, a latex of unique polymer architecture or morphology is created, leading to the unique rubbery properties of the cured films produced therefrom.

Another component of the release layer is a water resistant aid such as a polyurethane dispersion which provides a self-crosslinking solvent and emulsifier-free aqueous dispersion of an aliphatic urethane-acrylic hybrid polymer which, alone, produces a clear, crack-free film on drying having very good scratch, abrasion and chemical resistance. This ingredient is also a softener for the acrylic dispersion and plasticizer aid.

Such product may be produced by polymerizing one or more acrylate and other ethylenic monomers in the presence of an oligourethane to prepare oligourethane acrylate copolymers. The oligourethane is preferably prepared from diols and diisocyanates, the aliphatic or alicyclic based diisocyanates being preferred, with lesser amounts, if any, of aromatic diisocyanates, to avoid components which contribute to yellowing. Polymerizable monomers, in addition to the usual acrylate and methacrylate esters of aliphatic monoalcohols and styrene, further include monomers with carboxyl groups, such as acrylic acid or methacrylic acid, and those with other hydrophilic groups such as the hydroxyalkyl acrylates (hydroxyethyl methacrylate being exemplary). The hydrophilic groups in these monomers render the copolymer product dispersible in water with the aid of a neutralizing agent for the carboxyl groups, such as dimethylethanolamine, used in amount to at least partially neutralize the carboxyl groups after dispersion in water and vacuum distillation to remove any solvents used to prepare the urethane acrylic hybrid.

Further formulations may include the addition of crosslinking components such as amino resins or blocked polyisocyanates. Although pigments and fillers could be added to any of the coating layers, such use to uniformly tint or color the coated paper could be used for special effect, but would not be used where an image is desired in the absence of background coloration. Urethane acrylic hybrid polymers are further described in U.S. Pat. No. 5,708,072, and their description in this application is incorporated by reference.

Self crosslinking acrylic polyurethane hybrid compositions can also be prepared by the processes and materials of U.S. Pat. No. 5,691,425, herein incorporated by reference. These are prepared by producing polyurethane macromonomers containing acid groups and lateral vinyl groups, optionally terminal vinyl groups, and hydroxyl, urethane, thiourethane and/or urea groups. Polymerization of these macromonomers produces acrylic polyurethane hybrids which can be dispersed in water and combined with crosslinking agents for solvent-free coating compositions.

Autocrosslinkable polyurethane-vinyl polymers are discussed in detail in U.S. Pat. No. 5,623,016 and U.S. Pat. No. 5,571,861, and their disclosure of these materials is incorporated by reference. The products usually are polyurethane-acrylic hybrids, but with self-crosslinking functions. These may be carboxylic acid containing, neutralized with, e.g. tertiary amines such as ethanolamine, and form useful adhesives and coatings from aqueous dispersion.

The elastomeric emulsion and polyurethane dispersion are, generally, thermoplastic elastomers. Thermoplastic elastomeric polymers are polymer blends and alloys which have both the properties of thermoplastic polymers, such as having melt flow and flow characteristics, and elastomers, which are typically polymers which cannot melt and flow due to covalent chemical crosslinking (vulcanization). Thermoplastic elastomers are generally synthesized using two or more monomers that are incompatible; for example, styrene and butadiene. By building long runs of polybutadiene with intermittent polystyrene runs, microdomains are established which imparts the elastomeric quality to the polymer system. However, since the microdomains are established through physical crosslinking mechanisms, they can be broken by application of added energy, such as heat from a hand iron, and caused to melt and flow; and therefore, are elastomers with thermoplastic quality.

Thermoplastic elastomers have been incorporated into the present invention in order to provide the image transfer system with elastomeric quality. Two thermoplastic elastomer systems have been introduced; that is, a polyacrylate terpolymer elastomer (for example, Hystretch V-29) and an aliphatic urethane acryl hybrid (for example, Daotan VTW 1265). Thermoplastic elastomers can be chosen from a group that includes, for example, ether-ester, olefinic, polyether, polyester and styrenic thermoplastic polymer systems. Specific examples include, by way of illustration, thermoplastic elastomers such as polybutadiene, polybutadiene derivatives, polyurethane, polyurethane derivatives, styrene-butadiene, styrene-butadiene-styrene, acrylonitrile-butadiene, acrylonitrile-butadiene-styrene, acrylonitrile-ethylene-styrene, polyacrylates, polychloroprene, ethylene-vinyl acetate and poly(vinyl chloride). Generally, thermoplastic elastomers can be selected from a group having a glass transition temperature (Tg) ranging from about −50° C. to about 25° C.

Another component of the release layer is a plasticizer such as a polyethylene glycol dispersion which provides mechanical stability, water repellency, and allows for a uniform, crack-free film. Accordingly, a reason to add the polyethylene glycol dispersion is an aid in the coating process. Further, the polyethylene glycol dispersion acts as an softening agent. A preferred fourth component is Carbowax Polyethylene Glycol 400, available from Union Carbide.

Another optional ingredient of the release layer is a surfactant and wetting agent such as polyethylene glycol mono ((tetramethylbutyl) phenol) ether.

In another embodiment of the invention, the release layer comprises an acrylic binder and a wax emulsion. The release layer may further contain a retention aid such as Hercobond 2000®. The retention aid provides water resistance, which enhances the washability of the image on the receptor.

Various additives may be incorporated into the release layer or the barrier and/or image areas. Retention aids, wetting agents, plasticizers and water repellants are examples. Each will be discussed in turn, below.

An additive may be incorporated for the purpose of aiding in the binding of the applied colorant such as water-based ink jet colorants and/or dry or liquid toner formulations. Such additives are generally referred to as retention aids. Retention aids may be added in amounts of 0.5–90%, preferably 1–50%, most preferably 1–20% by weight. Retention aids that have been found to bind colorants generally fall into three classes: silicas, latex polymer and polymer retention aids. Silicas and silicates are employed when the colorant is water-based such as ink jet formulations. An example of widely used silicas are the Ludox (DuPont) brands. Polyvinyl alcohol represents as class of polymers that have also been applied to the binding of ink jet dyes. Other polymers used include anionic polymers such as Hercobond 2000 (Hercules). Reten 204LS (Hercules) and Kymene 736 (Hercules) are cationic amine polymer-epichlorohydrin adducts used as retention aids. Latex polymers include, by way of illustration, vinyl polymers and vinyl co-polymer blends such as ethylene-vinyl acetate, styrene-butadiene copolymers, polyacrylate and other polyacrylate-vinyl copolymer blends.

Wetting agents, rheology modifiers and surfactants may also be included in the release layer in amounts of 0.05–90%, preferably 1–50%, most preferably 1–20% by weight. Such agents may either be nonionic, cationic or anionic. The surfactant selected should be compatible with the class of polymers used in a formulation. For example, anionic polymers require the use of anionic or non-ionic wetting agents or surfactants. Likewise, cationic surfactants are stable in polymer solution containing cationic or non-ionic polymers. Examples of surfactants or wetting agents include, by way of illustration, alkylammonium salts of polycarboxylic acid, salts of unsaturated polyamine amides, derivatives of nonoxynol, derivatives of octoxynols (Triton X-100 and Triton X-114 (Union Carbide), for example), dimethicone copolymers, silicone glycol copolymers, polysiloxane-polyether copolymers, alkyl polyoxy carboxylates, tall oil fatting acids, ethylene oxide-propylene oxide block copolymers and derivatives of polyethylene glycol.

Viscosity modifiers may also be included in amounts such as 0.5–90%, preferably 1–50%, most preferably 1–20% by weight. Generally, various molecular weight polyethylene glycols are incorporated to serve this purpose. Polyethylene glycols used generally range in molecular weight from 100 to 500,000 with molecular weights between 200 and 1000 being the most useful in this application.

Plasticizers may be included in order to soften hard polymer and polymer blend additions. Plasticizers may be added in amounts of 0.5–90%, preferably 1–50%, most preferably 1–20% by weight. Plasticizers used include, by way of illustration, aromatic derivatives such as di-octyl phthalate, di-decyl phthalate derivatives and tri-2-ethylhexyl trimellitate. Aliphatic plasticizers include derivatives of ethylhexyl adipates and ethylhexyl sebacates. Epoxidized linseed or soya oils may also be incorporated but generally are not used due to yellowing and chemical instability upon heat application.

Water repellant aids may also be incorporated into order to improve the wash/wear resistance of the transferred image. Water repellant aids may be added in amounts of 0.5–90%, preferably 1–50%, most preferably 1–20% by weight. Examples of additives include polyurethanes, wax dispersions such as camauba wax, mineral waxes, montan wax, derivatives of montan wax, petroleum waxes, synthetic waxes such as polyethylene and oxidized polyethylene waxes, hydrocarbon resins, amorphous fluoropolymers and polysiloxane derivatives.

Suitable release layers also include those disclosed in U.S. provisional applications 60/127,625 filed Apr. 1, 1999 and 60/133,861 filed May 12, 1999, which are herein incorporated by reference.

In another embodiment the release layer of the present invention may contain (1) PCC, (2) PVP, or (3) both PCC and PVP (PCC/PVP) as additional constituent(s). The PCC or PVP or PCC/PVP which may be incorporated into the release layer are the same as described below with respect to the image receiving layers. It is to be noted that this blended release layer is still overcoated with one of the image receiving layers or images discussed below. This embodiment is described in U.S. Provisional Application No. 60/157,018, filed Oct. 1, 1999.

The release layer of the present invention may also contain salts which act as dye retention aids and drying additives. In this embodiment, Alkali earth (Group IIA), Group 3A and transition metal salts of halide or complex polyanions can be used as colorant retention and/or drying aids. Primarily, magnesium, calcium, aluminum, and zinc salts are selected since these counterions are known to complex with water-based colorants via electrostatic interactions. Metal colorant complexes of the said counterions are generally insoluble in water, once formed; and therefore, provide waterfast properties to an image comprising these complexed dyes. In addition, nano- or microcrystals of these metal salts would impart a drying property via a water hydration or absorption mechanism.

The image receiving layer of the present invention discussed below may also be formulated to contain these metal salts. By way of illustration, the following reactions may be performed within the Release Layer and/or Image Receiving Layer. General chemical formulas will be illustrated without notation as to the degree of water hydration.

| Reagent A | + Reagent B | = Product |
|---|---|---|
| | Reaction Scheme 1 | |
| $Ca_3$(Citrate) | $Na_2CO_3$ | $CaCO_3$ |
| $Ca(Acetate)_2$ | $K_2CO_3$ | $MgCO_3$ |
| $Mg_3$(Citrate) | $Na_x$(Polyanion B)$_y$ | $Al_2(CO_3)_3$ |
| $Mg_3$(Acetate) | $K_x$(Polyanion B)$_y$ | $Ca_x$(Polyanion B)$_y$ |
| $Ca_x$(Polyanion A)$_y$ | | $Mg_x$(Polyanion B)$_y$ |
| $Mg_x$(Polyanion A)$_y$ | | $Al_x$(Polyanion B)$_y$ |
| $Al_x$(Polyanion A)$_y$ | | |
| | Reaction Scheme 2 | |
| $Zn(Acetate)_2$ | $Na_2CO_3$ | $ZnCO_3$ |
| $Zn_3$(Citrate) | $K_2CO_3$ | $Zn_x$(Polyanion B)$_y$ |
| $ZnCl_2$ | $Na_x$(Polyanion B)$_y$ | |
| $Zn_x$(Polyanion)$_y$ | $K_x$(Polyanion B)$_y$ | |

The reaction schemes are read such that any Reagent A can react with any Carbonate salt to form the corresponding salt precipitate. Also, any Reagent A can react with any salt of a polyanion (Polyanion B) to form the corresponding insoluble salt precipitate. Polyanion B may be, by way of example, a carbonate, bicarbonate, phosphate, sulfate, bisulfate or any sugar or amino acid polyanionic counterion. Polyanion B may also be replaced by a halide anion such as Chloride or Bromide.

The reaction is performed under conditions that promote the formation of nano- or microcrystals, within the film layer formulation, prior to coating. For example, Calcium Acetate is reacted with Sodium Carbonate under both a rapid stirring and reagent injection rate. The two reactants can be injected together, under conditions of rapid stirring, in what is known as a double jet addition; or, one of the reagents may already be present in the film layer formulation; and then, the second component is rapidly injected under a protocol known as a single jet addition.

Under rapid stirring, the microcrystals formed would be evenly dispersed within the film layer formulation. The reagent concentrations can be adjusted to produce a final film layer formulation that contains between about 1 to about 95% precipitated salt. The Reagent B can be in molar excess relative to Reagent A. Alternatively, balanced molar relationships may be formulated between Reagents A and B.

6. The Image Receiving Layer or the Image

As discussed above, the transfer material may either contain an image receiving layer upon which an image is placed, or simply an image. The image receiving layer of the transfer material is designed to be receptive to any type of image formed by any type of dye, colorant, etc. The image of the transfer material is formed by a dye, colorant, etc, other than a transferable ink. Each of these layers, each with its own non-limitive examples are discussed below:

6.1 The Image Receiving Layer

An image receiving layer is to be applied over the release layer. Any type of image receiving layer is suitable. Examples include image receiving layers disclosed by the above applications and patents. Other examples are described below:

6.1.1 PCC/PVP-Containing Image Receiving Layer

This type of image-receiving layer is described in U.S. Provisional Application No. 60/157,018, filed Oct. 1, 1999. This application describes a transfer sheet comprising a support sheet having a first and a second surface; at least one release layer on the first surface of the support sheet; and an image receiving layer on the release layer(s). This transfer sheet provides for three types of image receiving layers: 1)

a PCC-containing image receiving layer, 2) a PVP-containing image receiving layer, and 3) a PCC/PVP-containing image receiving layer.

6.1.1.1 The PCC-Containing Image Receiving Layer

The PCC-containing image receiving layer comprises PCC, and optionally, a binder. Additives may also be optionally added.

PCC suitable for use may be purchased from any distributor. PCC is conventionally produced by bubbling a gas containing carbon dioxide through an aqueous suspension of calcium hydroxide. Other inorganic materials, in particular, inorganic materials containing aluminum, such as alum, can be coprecipitated with PCC, or can be precipitated onto the surface of the PCC precipitate. Additionally, the PCC may be heat aged and/or milled.

The PCC component of the PCC-containing image receiving layer is incorporated in an amount of from 20–100% by weight based on the total weight of the PCC-containing image receiving layer. If the amount of PCC used is below 20%, the PCC-containing image receiving layer is insufficient to cover the underlying layers and consequently, an image cannot be properly applied. Preferably, the PCC component of the PCC-containing image receiving layer is incorporated in an amount of from 50–95%, by weight based on the total weight of the PCC-containing image receiving layer. Most preferably, the PCC component of the PCC-containing image receiving layer is incorporated in an amount of from 75–95%, by weight based on the total weight of the PCC-containing image receiving layer. These % by weight amounts are calculated based on a PCC slurry containing 25% solids.

Binders suitable for use in the PCC-containing image receiving layer are the same as the binders which may be used in the release layer or the optional barrier layer of the present invention, both of which are discussed above.

Examples of binders also include, but are not limited to, polyvinyl alcohol ("PVOH") and derivatives thereof, oxidized starch, etherified starch, esterified starch, dextrin and like starches, carboxymethylcellulose, hydroxyethylcellulose and like cellulose derivatives, casein, gelatin, soybean protein, maleic anhydride resin, lattices of usual styrene butadiene copolymer, methyl methacrylate-butadiene copolymer and like conjugated diene polymers or copolymers, and lattices of acrylate and methacrylate polymers or copolymers and like acrylic polymers, and latex.

Specific examples of binders to be utilized in the PCC-containing image receiving layer include; Freepel FX-1202™, by BF Goodrich, an emulsion of wax, melamine and fluorochemical polymer; ethylene acrylic acid copolymer dispersion, Michem Prime 4983R, by Michelman; an elastomeric latex emulsion, and PVOH, Airvol 107 by Air Products.

The binder component of the PCC-containing image receiving layer is incorporated in an amount of from 0–80%, preferably 1–80% by weight based on the total weight of the PCC-containing image receiving layer. Preferably, the binder component of the PCC-containing image receiving layer is incorporated in an amount of from 1–40%, preferably 5–40% by weight based on the total weight of the PCC-containing image receiving layer. Most preferably, the binder component of the PCC-containing image receiving layer is incorporated in an amount of from 5–25% by weight based on the total weight of the PCC-containing image receiving layer.

When required, the PCC-containing image receiving layer may have further incorporated therein additives in amounts conventionally used in the art, such as conventional pigment dispersants, tackifiers, UV absorbers, mold inhibitors, antioxidants, optical brighteners, flowability modifiers, defoaming agents, foaming inhibitors, release agents, coloring agents, and dye binding additive as are known to those skilled in the art.

An example of a cationic dye binding additive used is OSC-470™, by Ontario Specialty Coatings.

The additives which are optionally added to the PCC-containing image receiving layer are added in small amounts of less than 25% by weight for all additives, based on the total weight of the PCC-containing image receiving layer.

The PCC-containing image receiving layer may be coated by any standard coating technique, for example, metered rod draw down, gravure, etc. Additionally, one or multiple PCC-containing image receiving layer may be applied.

The PCC-containing image receiving layer is coated with a dry weight of 1–15 g/m$^2$, preferably 1–10 g/m$^2$, most preferably 1–5 g/m$^2$. In practice, the PCC-containing image receiving layer is applied by a single pass with a No. 4 metered rod. Based on this single pass, the dry coat weight is 2.5–3 g/m$^2$.

The PCC-containing image receiving layer is applied with a thickness of 0.25–20 mils, preferably 0.25 to 5 mils, most preferably 0.4 mils.

After application, the PCC-containing image receiving layer may be dried by any drying technique, for example, air dry, forced air, element heating, etc.

6.1.1.2 The PVP-Containing Imagine Receiving Layer

The PVP-containing image receiving layer comprises PVP and optionally a binder. Additives may also optionally be added.

Crosslinked and non-crosslinked PVPs are suitable for use in this layer. Copolymers of the crosslinked or non-crosslinked PVP are also suitable for use, including but not limited to copolymers of PVP and polyvinylimidazoles, vinylimidazoles, vinyl acetates, polyvinyl acetates, vinyl acrylates, styrenes, polystyrenes, polyesters, polyolefins and polyamides.

The PVP component of the PVP-containing image receiving layer is incorporated in an amount of from 20–100% by weight based on the total weight of the image receiving layer. Preferably, the PVP component of the PVP-containing image receiving layer is incorporated in an amount of from 40–90%, by weight based on the total weight of the image receiving layer. Most preferably, the PVP component of the PVP-containing image receiving layer is incorporated in an amount of from 75–95%, by weight based on the total weight of the image receiving layer.

Binders suitable for use in the PVP-containing image receiving layer are the same as the binders which may be used in the PCC-containing image receiving layer, the release layer and the optional barrier layer of the present invention, all of which are discussed above.

The binder component of the PVP-containing image receiving layer is incorporated in an amount of from 0–80%, preferably 1–80% by weight based on the total weight of the image receiving layer. Preferably, the binder component of the PVP-containing image receiving layer is incorporated in an amount of from 10–60% by weight based on the total weight of the image receiving layer. Most preferably, the binder component of the PVP-containing image receiving layer is incorporated in an amount of from 35–50% by weight based on the total weight of the image receiving layer.

When required, the PVP-containing image receiving layer may have further incorporated therein additives in amounts conventionally used in the art, such as conventional pigment dispersants, tackifiers, UV absorbers, mold inhibitors, antioxidants, optical brighteners, flowability modifiers, defoaming agents, foaming inhibitors, release agents, coloring agents, and dye binding additive as are known to those skilled in the art. These are the same additives referred to above with respect to the PCC-containing image receiving layer.

The additives which are optionally added to the PVP-containing image receiving layer are added in small amounts of less than 25% by weight for all additives, based on the total weight of the image receiving layer.

The PVP-containing image receiving layer may be coated by any standard coating technique, for example, metered rod draw down, gravure, etc. Additionally, one or multiple PVP-containing image receiving layer may be applied.

The PVP-containing image receiving layer is coated with a dry weight of 1–100 g/m$^2$, preferably 2–50 g/m$^2$, most preferably 2–30 g/m$^2$.

The PVP-containing image receiving layer is applied with a thickness of 0.05–2.00 mils, preferably 0.1 to 2.0 mils, most preferably 0.5–1.5 mils.

After application, the PVP-containing image receiving layer may be dried by any drying technique, for example, air dry, forced air, element heating, etc.

6.1.1.3. The PCC/PVP-Containing Image Receiving Layer

The PCC/PVP-containing image receiving layer comprises PCC, PVP and optionally a binder. Additives may also optionally be added. Suitable PCC and PVP are the same as the PCC and PVP which are described above.

The PCC component of the PCC/PVP-containing image receiving layer is incorporated in an amount of from 0.1–95%, preferably 5–85%, more preferably 30–70% by weight based on the total weight of the image receiving layer.

The PVP component of the PCC/PVP-containing image receiving layer is incorporated in an amount of from 5–99.9%, preferably 10–95%, more preferably 20–85% by weight based on the total weight of the image receiving layer.

Binders suitable for use in the PVP-containing image receiving layer are the same as the binders which may be used in the PCC-containing image receiving layer, the release layer and the optional barrier layer of the present invention, all of which are discussed above.

The binder component of the PCC/PVP-containing image receiving layer is incorporated in an amount of from 0–80%, preferably 1–80%, more preferably 5–40%, most preferably 5–25% by weight based on the total weight of the image receiving layer.

When required, the PCC/PVP-containing image receiving layer may have further incorporated therein additives in amounts conventionally used in the art, such as conventional pigment dispersants, tackifiers, UV absorbers, mold inhibitors, antioxidants, optical brighteners, flowability modifiers, defoaming agents, foaming inhibitors, release agents, coloring agents, and dye binding additive as are known to those skilled in the art. These are the same additives referred to above with respect to the PCC-containing image receiving layer.

The additives which are optionally added to the PCC/PVP-containing image receiving layer are added in small amounts of less than 25% by weight for all additives, based on the total weight of the image receiving layer.

The PCC/PVP-containing image receiving layer may be coated by any standard coating technique, for example, metered rod draw down, gravure, etc. Additionally, one or multiple PVP-containing image receiving layer may be applied.

The PCC/PVP-containing image receiving layer is coated with a dry weight of 1–100 g/m$^2$, preferably 2–50 g/m$^2$, most preferably 2–30 g/m$^2$.

The PCC/PVP-containing image receiving layer is applied with a thickness of 0.05–2.00 mils, preferably 0.1 to 2.0 mils, most preferably 0.5–1.5 mils.

After application, the PCC/PVP-containing image receiving layer may be dried by any drying technique, for example, air dry, forced air, element heating, etc.

6.2 The Image

An image may be applied over the image receiving layer or directly onto any underlying layer such as the support or release layer. However, if the transfer material contains only (1) a support, and (2) an image, the image is not formed using a transferable ink. Although, if any additional components are present, the image formed may be formed using a transferable ink. For example, if a transfer layer or antistatic layer is present, or an image receiving layer is utilized, or if any other intermediate or overlaying layer is present, any type of ink may be used. Also, if the transfer material is one of those described in the above Provisional U.S. Applications, the image may be formed using any type of ink including transferable inks.

The image may be applied by a conventional printing process, including by ink jet printers, laser jet printers or copiers, crayons, application of halftone and color separations to the heat release layer by lithographic offset printing or other standard surface-to-surface printing processes. The halftone or full color processes may utilize standard air-drying process inks or latex-based air-drying inks. Printing may be conducted as a positive or negative image.

Suitable images can be obtained using standard lithographic inks. The inks should be selected so that the inks are compatible with the later heat treatment which is necessary to transfer the image to the receptor element. Heat resistant inks are, therefore, preferred. Drying speed can be improved by modifying the ink compositions to use a low quantity of drying oils and/or fast drying oils. The inks should also be selected such that the inks of the color separations are compatible with each other and with subsequent heat processing in order to produce an accurate sharp ink design.

Suitable inks having the properties identified above can be prepared by combining conventional red (rhodamine), yellow (benzedrine), blue (cyan) and black (process black) inks with an ink vehicle containing suitable resins and drying oils. A preferred ink vehicle contains 5–20 wt. %, preferably 7–13 wt. % of a drying (oxidizing) oil alkyd resin having an acid number of 2–25, preferably 5–20 and a Gardener Holdt viscosity of Z4 to Z6 at 25° C. The alkyd resin is preferably prepared using a sufficient amount of drying oil such that the oil length of the alkyd can be classified as a long oil alkyd of 50–90 wt. %, preferably 65–80 wt. % oil content.

The preferred ink vehicle also contains one or more esters of a modified rosin or polymerized rosin acid in an amount of about 5–30 wt. %, preferably 10–25 wt. %. These esters will generally have a melting point of about 120° C. to 220° C., preferably 140° C. to 190° C. and an acid number of 5–35, preferably 8–25. In a particularly preferred embodiment, two pentaerythritol esters of modified rosin and polymerized rosin acids are used, 5–10 wt % of a first ester having a melting point of 140° C. to 155° C. and an acid number of 8–25, and 5–15 wt. % of a second ester having a melting point of 175° C. to 190° C. and an acid number of 8–17.

Finally, the ink vehicle contains one or more drying oils in an amount of 2–15 wt. %, preferably 4–8 wt. %. Suitable drying oils include linseed oil, tung oil, etc., and mixtures thereof. Ink oils, preferably high boiling petroleum hydrocarbon fractions, are preferred solvents for the ink vehicle. Such ink oils are well known and generally have a boiling point range from about 200 to 300° C., preferably 225–275° C. and a K. B. value of 20–35, preferably 24–30. The ink oils and drying oils solubilize the alkyd resin enabling smooth application of the ink-containing vehicle with conventional lithographic offset printing equipment.

The image may be formed through the use of laser printers or copiers, ink jet printers, bubblejet printers, thermal inkjet methods, piezo inkjet methods, cycolor printers, photographic printers, and the like.

7. The Optional Non-Water-Dispersible Polymer Layer

Provisional U.S. Application No. 60/134,849, filed May 19, 1999 discusses a polymer layer containing a non-water-dispersible polymer that is optionally coated over the image. The non-water-dispersible polymer layer may be applied by any suitable coating process. Conveniently, the non-water-dispersible polymer layer is applied from a conventional coating tower suitable for use with lithographic offset printing equipment. The polymer coat formed by this process may be air-dried or, preferably is dried using an infrared dryer.

The non-water-dispersible polymer layer is for example, a plastisol. Generally, a plastisol is a dispersion of polyvinylchloride (PVC) particles in liquid organic media. Plastisols are prepared using high boiling liquids which are absorbed by and plasticize the particles, and remain in the final product. Accordingly, the plastisols suitable for use in the non-water-dispersible polymer layer are preferably plastisols which fall into the vinyl polymer class. For example, vinyl chloride polymers and copolymers. These vinyl polymers are generally polyvinyl chloride (PVC) polymer formulations. These PVC polymer formulations contain, in combination with PVC, for example, phthalate esters, inert fillers and/or organic/inorganic pigments. Specifically suitable examples include, but are not limited to, TransFlex Series, XL Flash 360 White (also known as Phantom White), and Bright Tiger White, all by Wilflex. These Wilflex products are composed of PVC, phthalate esters, inert fillers, and optionally organic/inorganic pigments.

The non-water-dispersible polymer layer can also be applied as a clear coat base. For example, a clear plastisol base such as Soft Hand Clear #10140, by Wilflex. This clear plastisol base may also be combined with pigmented inks to form a colored non-water-dispersible polymer layer.

If viscosity modification is desired, reducers may be added. For example, if viscosity reduction is desired, up to 5 wt. % of a reducer, such as Wilflex Curable Reducer #10070, may be added.

The polymers are commercially available for coating graphic arts paper or paper board with an in-line coater. The polymer dispersion is applied at a rate of 0.5–6.0, preferably 1.5–5.0 lbs. per 1300 $ft^2$. The non-water-dispersible polymer layer is preferably applied using a 350 to 65 mesh. Dry coat weights range from about 10 to about 100 $g/m^2$, preferably about 50 $g/m^2$.

In another embodiment, the non-water-dispersible polymer layer is applied over the image areas of the image only and the transfer blocking overcoat layer is applied over the non-image areas of the image only.

8. The Optional Transfer Blocking Overcoat Layer

Provisional U.S. Application No. 60/134,849, filed May 19, 1999 describes a transfer blocking overcoat layer that is optionally applied over the image or over the optional non-water-dispersible polymer layer of the present invention. Alternatively, as discussed above, a transfer blocking overcoat layer may be applied over the non-image areas of the image only and the optional non-water-dispersible polymer layer may be applied over the image areas of the image only.

The transfer blocking overcoat layer may be applied using a conventional printing process, preferably a conventional screen printing process. The transfer blocking overcoat layer is printed over the optional non-water-dispersible polymer layer or the non-image areas of the image, such that the transfer blocking overcoat layer outlines one or more of the image areas present in the image. That is, the transfer blocking overcoat layer outlines at least one imaged area or selected imaged areas and thereby circumferentially defines the outer boundary of each imaged area which will be transferred during the heat transfer process. "Selected imaged areas" is refers to an image area which is less than the entire image area present in the image. In other words, if an imaged area is to be outlined by the transfer blocking overcoat layer, if desired, only a portion (or "selected imaged areas") need be outlined. Thus, a plurality of imaged areas may be present in a single image, where the transfer blocking overcoat layer simultaneously defines the boundary of each imaged area or selected imaged areas. Preferably, the transfer blocking overcoat layer is applied to the optional polymer layer or the image so that the transfer blocking overcoat layer covers the entire transfer sheet except the portion of the transfer sheet within the outline circumscribing the image area or areas which will be transferred. The transfer blocking overcoat layer does not cover the image area within the outline, that is, the transfer blocking overcoat layer is not present on the optional polymer layer or the image within the outline of the image area. It is noted that the phrase "selected image area" applies to the application of both the non-water-dispersible polymer layer and the transfer blocking overcoat layer.

The transfer blocking overcoat layer may additionally be coated such that it overlaps the outer perimeter of the image area to a small degree, for example, about one eighth of an inch.

To apply the transfer blocking overcoat layer several conventional techniques including but not limited to flexo, gravure, lithographic techniques and metering rod coating. First, the artisan must determine what portions of the image areas which are desired to have a defined edge free from a polymer halo. Once this is established, the transfer blocking overcoat layer is applied, by one of the above methods to the boundary of that selected image area.

Application of sufficient heat (e.g., through the support) transfers the optional non-water dispersible polymer layer, image, image receiving layer, and heat release layer within the outline of the transfer blocking overcoat, onto and/or into the receptor element.

The transfer blocking overcoat layer is, preferably, a thermosetting lacquer composition which fuses with the underlying optional polymer layer, image, image receiving layer, heat transfer layer, and optional barrier layer when heat is applied to the transfer sheet, thereby preventing transfer of any portion of the transfer sheet which is covered by the transfer blocking overcoat layer. The transfer blocking overcoat layer is non-adhesive to the receptor and prevents formation of a polymer halo on the receptor element.

The transfer blocking overcoat layer can be formed from a conventional industrial screen ink lacquer. The composition of the industrial lacquer may be varied widely and is not particularly limited so long as the lacquer is non-adhesive to the receptor and bonds to the underlying optional polymer layer or image, preventing heat transfer of the underlying layer. The industrial lacquer is preferably a polymeric, crosslinked resin material which may, optionally, contain a solid filler or pigment. Suitable crosslinked polymeric materials include epoxy-polyesters, epoxy-polyamides, polyisocyanate/polyester mixtures, polyisocyanate/polyol mixtures, urethane/acrylic mixtures. The transfer blocking overcoat may be opaque or transparent, or may contain a pigment or filler to impart a desired color. Preferably, the transfer blocking overcoat is clear or opaque to avoid any possibility of color transfer to the receptor element during the heat transfer process.

The industrial lacquer used to form the transfer blocking overcoat layer may contain two or more crosslinkable polymeric components which react together to form the crosslinked transfer blocking overcoat layer. For example, a first component such as polymethyl polyphenylisocyanates, aromatic and aliphatic polyisocyanate prepolymers, toluene diisocyanate based adducts, copolymers of aromatic and aliphatic polyisocyanates, toluene polyisocyanurate, polyfunctional aliphatic isocyanates, blocked isocyanate prepolymers, 2,4-toluene diisocyanates, prepolymers of diphenyl methane LO diisocyanates, epoxy and oxirane resins may be combined with a second component such as hydroxyl terminated castor oils, hydroxyl terminated linear and branched polyesters, acrylic resins and reactive polyamides to form a suitable crosslinkable thermosetting lacquer. The ratio of the first component to the second component is about 80:20 parts by weight to about 40:80 parts by weight, respectively. If desired, an organic solvent such as cellulose acetate butyrate or nitrocellulose solution may be used to dissolve the first and second lacquer components. The industrial screen ink lacquer of the transfer blocking overcoat layer is generally applied as a solution or dispersion in an organic solvent. Typically, the solvent constitutes about 10–80 parts by weight of the solution or dispersion. Acceptable solvents include alkyl, aryl and aralkyl ethers, aliphatic and aromatic hydrocarbons, as well as alkyl, aryl and aralkyl alcohols. Suitable lacquers are well known in the art and described, for example, in U.S. Pat. No. 3,959,555, U.S. Pat. No. 4,517,044, etc. Some industrial screen ink lacquers are available in the IL-000 series (tradename) of Nazdar Company, Chicago, Ill. which contain about 25–45 wt. % 2-butoxyethanol, 0–35 wt. % pigments, 10–20 wt. % resin material, 5–10 wt. % isopropanol, 0–16 wt. % petroleum distillates containing aromatic hydrocarbons, 0–6 wt. % crystalline silica, less than 4 wt. % toluene and 0–2 wt. % naphthalene.

Other non-limiting examples of the transfer blocking overcoat include, UVitec Aliphatic Coating (18846-87), UVitec Aromatic Coating (18955-87), UVitec Aliphatic Coating (18954-87), Sun Chemical UV RCF01498R, Epoxy Acryalate Varnish (INTER/LTV-KOTE) by International Ink Company, and Cationic UV Overprint Varnishes (UCB Radcure Formulation). The INTER/UV-KOTE by International Ink Company is a clear to light amber colored viscous liquid having a specific gravity of less than 1.2. Preferred formulations are UVitec Aliphatic Coating (18846-87) and Sun Chemical UV RCF01498R.

The transfer blocking overcoats may have a range of UV activated crosslinking concentrations of from about 0.01% to 20% by weight. For example, the Sun Chemical UV may have additional added photoinitiator and monomer at concentrations from 0.01% to 20% by weight.

The transfer blocking overcoat layer may be applied with a screen size from 110 to 375 mesh, preferably 350 mesh. The transfer blocking overcoat layer is applied with a dry coat weight of 5 to 50 g/m$^2$, preferably 12 g/m$^2$. These coatings are applied by screen printing but could be applied by other methods (i.e., gravure, air knife, metered rod, etc.) with the coat weights above.

In another embodiment, the transfer blocking overcoat layer is not applied. Therefore, the transfer sheet contains only a support, an optional barrier layer, an optional antistatic layer, at least one release layer, an image receiving layer, an image and an optional non-water-dispersible polymer layer. The non-water-dispersible polymer layer may cover the entire image or only the imaged areas or selected image areas.

9. Optional Opaque Layers

Optionally one or more opaque layers may be coated in turn onto the Release Layer. Said optional opaque layer(s) adds a rigid or stiff quality to the transfer sheet for ease of handling, as well as having opacity, especially white, to enhance visibility of the image when placed thereon.

When one or more opaque layers are employed, the opaque layer supports the image receiving layer(s) and serves to render the image visible against a dark receptor, and otherwise improves the appearance and readability of an image, such as, for instance, a bar code or a color image.

Upon peeling, the transfer material may carry some of the PSA along with the adhesive layers(s) and the opaque layer(s). For example, when permanently adhering the transfer material to a textile, the opaque layer(s) preferably will be thermoplastic and optionally thermosetting as they are applied to a porous substrate such as a fabric. When a thermosettable formulation is employed for the pressure sensitive adhesive and/or opaque layers, the transfer material fused into the fabric will have the maximum resistance to washing or dry cleaning.

9.1 Opaque Layer A

The first optional opaque layer (Opaque layer A) adds a rigid or stiff quality to the entire heat-setting label sheet for ease of handling, as well as having a white (or colored) opacity. Any pigmented resin may be used to achieve the desired outcome.

A preferred embodiment of opaque layer A, Opaque Layer formulation 1 comprises styrene-butadiene latex, thermoplastic elastomer, an elastomer and an optional pigment.

All the above chemicals form a homogeneous dispersion aided by a stir bar at a low to medium stir rate. All mixing can be done at room temperature. After coating, the preferred thickness of Opaque Layer A is about 1.5 mils (wet).

In the above-described preferred embodiment, a pigment such as a white pigment may be used to exhibit opacity capabilities. Also in the preferred embodiment, the latex is the primary chemical imparting the rigid characteristics upon drying. The thermoplastic elastomer and acrylic copolymer impart stretchability and flexibility in the final transferred product.

9.2. Opaque Layer B

Another optional opaque layer is Opaque Layer B, which preferably contains a pigment (such as a white pigment) and provides opacity. A preferred embodiment of the optional opaque layer B. Opaque Layer Formulation 1, comprises a vinyl acetate-ethylene copolymer, thermoplastic elastomer, an elastomer and an optional pigment such as $TiO_2$.

The thermoplastic elastomer acrylonitrile copolymer impart stretchability and flexibility in the final transferred product. Practically any $TiO_2$ powder addition, present at about 25% of the total formula, will provide the desired opacity. Other powdered pigments may need to be added at varying percentages to achieve the desired opacity and color intensity.

All liquid chemicals are homogenized in the presence of a stir bar and a low speed. Upon homogenization, the pigment powder is added slowly in the presence of a high stir speed provide by a stir flea. All mixing of the above ingredients should be performed at room temperature. Preferably, optional Opaque Layer B is coated on the heat setting label sheet at a weight of about 1.0 to 1.5 mils (wet).

Application of Layers

The various layers of the transfer material are formed by known coating techniques, such as by curtain coating, Meyer rod, roll, blade, air knife, cascade and gravure coating procedures.

The first layer to be coated on the support is the optional barrier layer. The barrier layer, if present, is followed by the release or transfer layer, followed by the image receiving layer and/or the image, followed by the optional non-water dispersible polymer layer, followed by the optional transfer blocking overcoat layer. Alternatively, the image receiving layer and the transfer layer may be a single layer.

Figure 1:
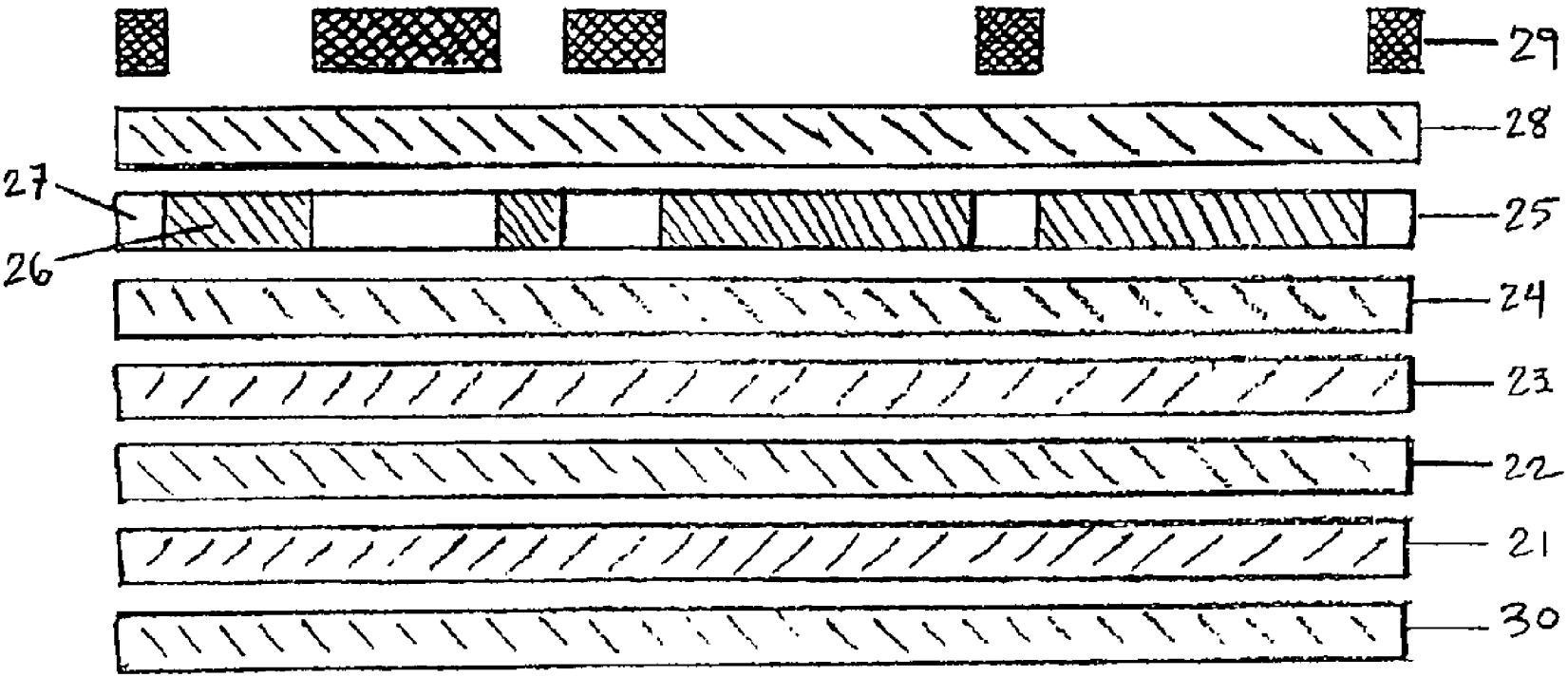
FIG. 1 is a cross-sectional view of one embodiment of the transfer element of the present invention.

In referring to FIG. 1, there is generally illustrated a cross-sectional view of one embodiment of the transfer sheet of the present invention. The support 21 comprises a top and bottom surface. The optional barrier layer 22 is coated onto the top surface of the support 21. The release layer 23 is then coated onto the optional barrier layer 22. The image receiving layer 24 is coated on top of the heat release layer 23. The image 25 is coated on top of the image receiving layer 24. The image 25 contains both image areas 26 and non-image areas 27. The optional non-water-dispersible polymer layer 28 is coated on top of the image 25. The optional transfer blocking overcoat layer 29 is coated on top of the optional non-water-dispersible polymer layer 28, such that the optional transfer blocking overcoat layer 29 outlines one or more of the image areas 26 present in the image 25. The antistatic agent may optionally be applied to the non-coated side of the support as an optional antistatic layer 30.

Figure 2:
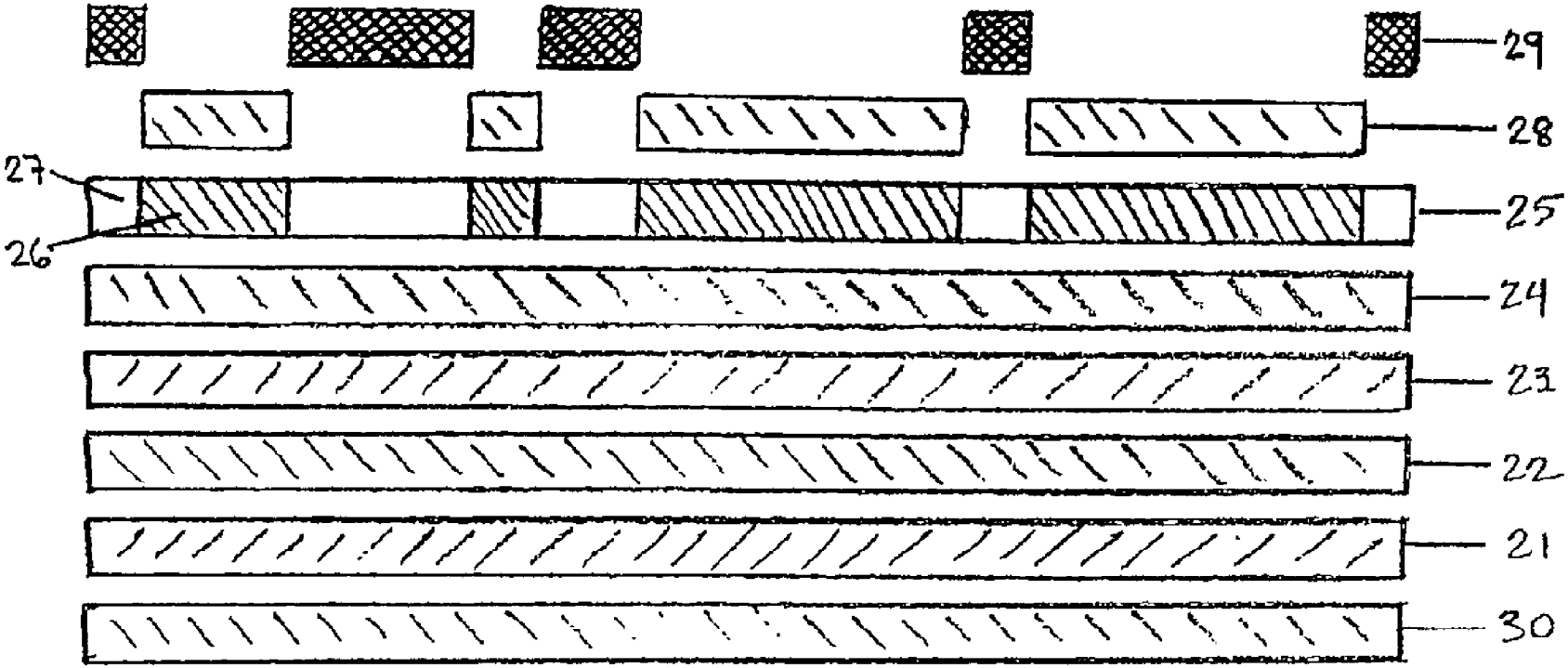
FIG. 2 is a cross-sectional view of another embodiment of the transfer element of the present invention.

In referring to FIG. 2, there is generally illustrated a cross-sectional view of one embodiment of the transfer sheet of the present invention. The support 21 comprises a top and bottom surface. The optional barrier layer 22 is coated onto the top surface of the support 21. The release layer 23 is then coated onto the optional barrier layer 22. The image receiving layer 24 is coated on top of the heat release layer 23. The image 25 is coated on top of the image receiving layer 24. The image 25 contains both image areas 26 and non-image areas 27. The optional non-water-dispersible polymer layer 28 is coated on top of one or more of the image areas 26 of the image 25. The optional transfer blocking overcoat layer 29 is coated on top of the non-image areas 27 of the image 25, such that the optional transfer blocking overcoat layer 29 outlines one or more of the image areas 26 present in the image 25. The antistatic agent may optionally be applied to the non-coated side of the support as an optional antistatic layer 30.

C. Receptor Element

The receptor or receiving element receives the transferred image. A suitable receptor includes but is not limited to textiles including cotton fabric, and cotton blend fabric. The receptor element may also include glass, metal, wool, plastic, ceramic or any other suitable receptor. Preferably the receptor element is a tee shirt or the like.

The image, as defined in the present application may be applied in any desired manner. For example, the image may be formed by a color or monochrome laser printer, laser copier, bubblejet printer, inkjet printer, cycolor printer, photographic printer, and the like.

To transfer the image, the imaged transfer element is placed image side against a receptor element. A transfer device (i.e., a hand iron or a conventional pneumatic heat press) is used to apply heat to the substrate which in turn releases the image. The temperature transfer range of the hand iron is generally in the range of 110 to 220° C. with about 190° C. being the preferred temperature. The pneumatic heat press operates at a temperature transfer range of 100 to 220° C. with about 190° C. being the preferred temperature.

The transfer device is placed over the non-image side of the support and moved in a circular motion (hand iron only) in accordance with manufacturers recommendations for conventionally know products. Pressure (i.e., typical pressure applied during ironing) must be applied as the heating device is moved over the support (see FIG. 3). The time of application of heat and pressure is directly proportional to the size of the image being transferred. For example, for a 8.5 inch×11 inch image, after about two minutes to five minutes (with about three minutes being preferred) using a hand iron and 10 seconds to 50 seconds using a heat press (with about twenty seconds being preferred) of heat and pressure, the transfer device is removed from the support. For a smaller 2 inch×3 inch image, after about 5 to 25 seconds (with about 15 seconds being preferred) using a hand iron, the transfer device is removed from the support. The transfer material is optionally allowed to cool from one to five minutes. The support is then peeled away from the image which is adhered to the receptor.

Figure 3:
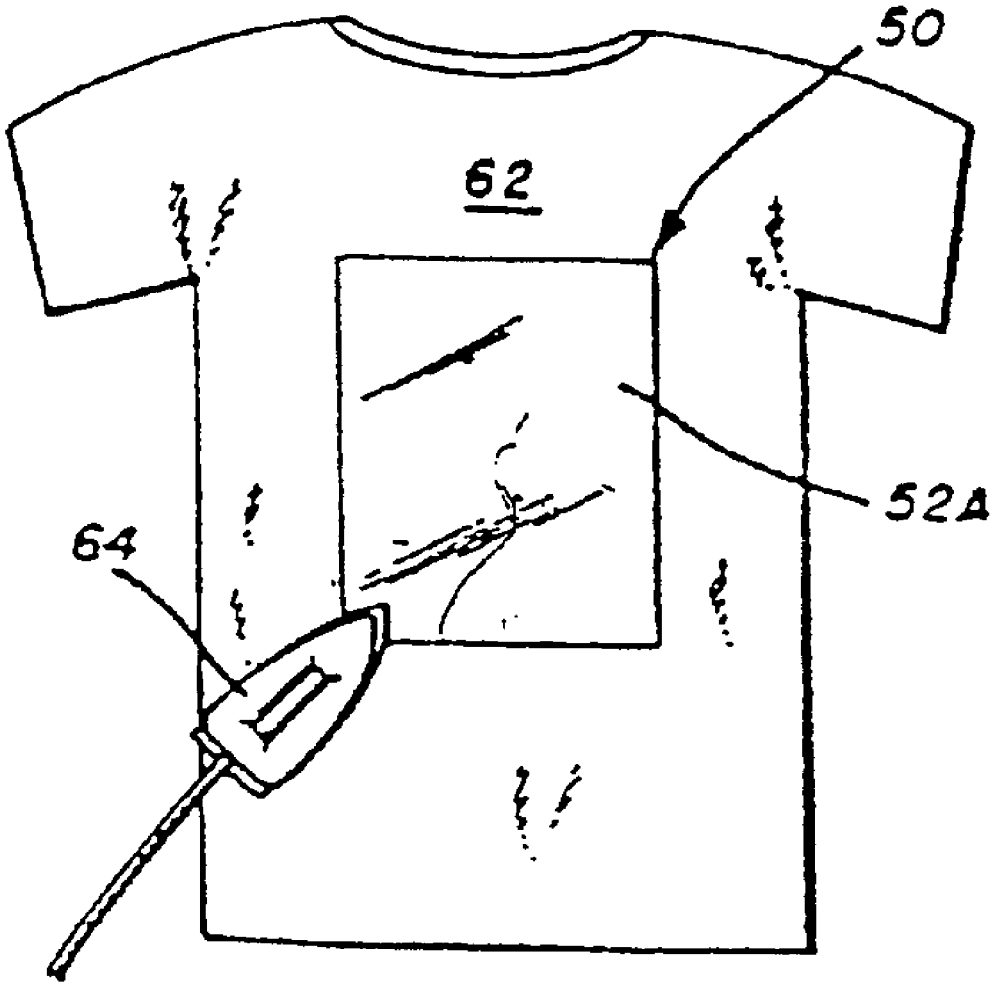

Referring to FIG. 3, the method of applying an image to a receptor element will be described. More specifically, FIG. 3 illustrates how the step of heat transfer from the transfer sheet 50 to a tee shirt or fabric 62 is performed. A tee shirt 62 is laid flat, as illustrated, on an appropriate support surface, and the imaged surface of the transfer sheet 50 is positioned onto the tee shirt. An iron 64 set at its highest heat setting is run and pressed across the back 52A of the transfer sheet. The image is transferred to the tee shirt and the transfer sheet is removed and discarded.

In an alternative embodiment, the imaged transfer layer is peeled from the support prior to transfer. The peeled imaged transfer layer is then placed against a receptor element with the image layer preferably up. A tack-free sheet, such as any tack-free sheet in the art, including but not limited to a silicone sheet, a sheet coated with a barrier layer according to the present invention, or a substrate sheet, is then placed over the image. Next, heat and pressure are applied to the top of the tack-free sheet sufficient to transfer the image to the receptor element. The tack free sheet is then removed.

The following examples are provided for a further understanding of the invention, however, the invention is not to be construed as limited thereto.

EXAMPLES

Example 1

In one embodiment of the invention, the barrier layer is a vinyl acetate polymer. An example of this embodiment is Barrier Layer Formulation 1:

Barrier Layer Formulation 1

| Components | Parts |
|---|---|
| Vinyl acetate-dibutyl maleate polymer dispersion (such as EVERFLEX G, Hampshire Chemical Corporation) | 50 parts |
| Water | 50 parts. |

Barrier Layer Formulation 1 may be prepared as follows: fifty parts of a vinyl acetate-dibutyl maleate polymer dispersion are combined with fifty parts of water by gentle stirring. The stirring is continued for approximately ten minutes at a moderate stir rate (up to but not exceeding a rate where cavitation occurs). The amount of water added may vary. The only limitation is that sufficient water is added to make the dispersion coatable on the substrate.

Example 2

An example of the PMMA-containing barrier layer is Barrier Layer Formulation 2:

Barrier Layer Formulation 2

| Components | Parts |
|---|---|
| Acetone 99.5% | 40 parts (weight) |
| 2-Propanol 99.5% | 40 parts (weight) |
| PMMA | 20 parts (weight). |

Barrier Layer Formulation 2 may be prepared as follows: The acetone and 2-propanol are weighed and mixed. The mixture is stirred. One half of the PMMA is added to the mixture while the mixture is heated to about 25° C. and stirring continues until the PMMA is dispersed. At this point, stirring continues until the remainder of the PMMA is added to the mixture and is dispersed. The mixture is then allowed to cool to room temperature.

Example 3

Another example of the barrier layer of the present invention is Barrier Layer Formulation 3:

| Compound | Chemical Class | General (parts by mass) | Preferably (parts by mass) | Most Preferably (parts by mass) |
|---|---|---|---|---|
| Uvacure 1500[a] | Cycloaliphatic epoxide | 10.0–60.0 | 20.0–50.0 | 30.0–40.0 |
| Uvacure 1562[b] | cycloalipahtic epoxy resin | 40.0–0.0 | 30.0–10.0 | 25.0–15.0 |
| DEN 431[c] | epoxy novolac | 5.0–30.0 | 10.0–20.0 | 12.0–18.0 |
| 2-propanol | resin alcohol | 44.4–0.0 | 38.3–12.4 | 30.8–21.7 |
| Uvacure 1590[a] | activated epoxy | 0.5–7.0 | 1.5–6.0 | 2.0–4.0 |
| Ebecryl BPO[a] | aryl ketone | 0.1–1.0 | 0.2–0.6 | 0.2–0.5 |
| BYK 354[c] | polyacrylate | 0.0–1.0 | 0.0–0.5 | 0.0–0.4 |
| BYK 088[c] | polysiloxane | 0.0–1.0 | 0.0–0.5 | 0.0–0.4 |

[a]UCB Chemical Corporation - Radcure Business Unit
[b]Dow Chemicals
[c]BYK Chemie Barrier Layer Formulation 3 is prepared as follows: DEN 431, an extremely viscous material, is placed into a beaker first, followed by 2-propanol. The remaining compounds are added in the order in which they appear listed in the table. Manual agitation may be required especially because of the extreme viscosity of DEN 431. Once mechanical agitation is used, the mixture is stirred for about 30–60 minutes at a rate just below the point where cavitation would have occurred.

Example 4

A barrier layer comprising Barrier Layer Formulation 3 is cured as follows: a thin film of barrier layer formulation 1, in the range of 1.0 g/m$^2$ to 20 g/m$^2$, is applied to a support and cured at <50 mJ/cm$^2$ with a mercury vapor ultraviolet lamp.

Example 5

Example 4 is repeated, and after UV curing, the film is further cured at temperatures between 60° C. and 200° in a heat chamber for 1 to 45 minutes.

Example 6

This example relates to a release layer formulation, Release Layer Formulation 1:

Release Layer Formulation 1

| Components | Parts by weight |
|---|---|
| Ethylene Acrylic Acid Co-polymer Dispersion (Michem Prime 4983R, Michelman) | 86 parts |
| Elastomeric emulsion (Hystretch V-29, B F Goodrich) | 5 parts |
| Polyurethane Dispersion (Daotan VTW 1265, Vianova Resins) | 4 parts |
| Polyethylene Glycol (Carbowax Polyethylene Glycol 400, Union Carbide) | 4 parts |
| Polyethylene Glycol Mono ((Tetramethylbutyl) Phenol) Ether (Triton X-100, Union Carbide) | 1 part |

Release Layer Formulation 1, as an embodiment of the invention suitable for laser copiers and laser printers, is wax free. Release Layer Formulation 1 may be prepared as follows: five parts of the elastomer dispersion are combined with eighty-six parts of an ethylene acrylic acid co-polymers dispersion by gentle stirring to avoid cavitation. Four parts of a polyurethane dispersion are then added to the mixture. Immediately following the addition of a polyurethane dispersion, four parts of a polyethylene glycol and one part of an nonionic surfactant (e.g., Triton X-100) are added. The entire mixture is allowed to stir for approximately fifteen minutes at a moderate stir rate (up to but not exceeding a rate where cavitation occurs). Once thoroughly combined, the mixture is filtered (for example, through a 53 μm nylon mesh).

Example 7

This example relates to another release layer formulation, Release Layer Formulation 2.

Release layer Formulation 2

| Components | Parts |
|---|---|
| Ethylene Acrylic Acid Co-polymers dispersion (Michem Prime 493 SR, Michelman) | 74 parts (weight) |
| Wax Dispersion (Michelman 73635M, Michelman) | 25 parts (weight) |
| Retention Aid (Hercobond 2000, Hercules) | 1 part (weight) |

Formulation 2 works in a laser printer or copier despite the presence of wax since the wax is present in sufficiently low amounts so as to not adversely affect imaging such as, for example, by melting within the printer or copier (i.e., at most about 25 parts (weight)).

Formulation 2 may be prepared in the following manner: the ethylene acrylic acid co-polymer dispersion and the wax dispersion are stirred (for example in a beaker with a stirring bar). The retention aid is added, and the stirring continues until the retention aid is completely dispersed.

In another embodiment of the invention, the above-described release layer is divided into two separate layers.

An example of this embodiment is a layer comprising ethylene acrylic acid that allows release or separation. An elastomer and polyurethane of the present invention, as well as any additives discussed above, are combined in a second layer that provides the above-described transfer qualities.

Example 8

This example relates to a PCC-containing image receiving layer formulation, PCC-containing Image Receiving Layer Formulation 1:

PCC-containing Image Receiving Layer Formulation 1

| Components | Parts (by weight) |
|---|---|
| Ethylene Acrylic Acid Co-polymers Dispersion (Michem Prime 4983R, 4990, 4983R-HS, or 4983-40R by Michelman) | 30 parts |
| Elastomeric latex emulsion (Hystretch V-29, B F Goodrich) | 5 parts |
| Polyvinyl Alcohol, 7% solution (Airvol 107 by Air Products) | 30 parts |
| Precipitated Calcium Carbonate (JETCOAT 30, Specialty PCC, Specialty Minerals) | 35 parts |

Alternatively, the binders suitable for Release Layer Formulation 1 may be used in lieu of the above-described ethylene acrylic acid copolymer dispersion.

PCC-containing image release layer formulation 1 is prepared by mixing each of the constituents until cavitation does not occur. The order of mixing is not important.

Example 9

This example relates to is another PCC-containing image receiving layer formulation, PCC-containing Image Receiving Layer Formulation 2:

PCC-containing Image Receiving Layer Formulation 2

| Compound | Parts (by weight) |
|---|---|
| Precipitated Calcium Carbonate (JETCOAT 30, Specialty PCC, Specialty Minerals) | 93 parts |
| Cationic Polymer (OSC-470) | 2 parts |
| Emulsion of wax, melamine, and fluorochemical polymer (Freepel, FX-1202,) | 5 parts |

PCC-containing image release layer formulation 2 is prepared by mixing each of the constituents until cavitation does not occur. The order of mixing is not important.

Example 10

This example relates to is a PVP-containing image receiving layer formulation, PVP-containing Image Receiving Layer Formulation 1:

PVP-containing Image Receiving Layer Formulation 1

| Compound | Parts (by weight) |
|---|---|
| Water | 58 |
| PVP (Luvicross M, crosslinked PVP by BASF) | 22 |
| Copolymer dispersion (Michem Prime 4983R, by Michelman) | 13 |
| Elastomeric Latex Emulsion (Hystretch V-29, by B F Goodrich) | 2 |
| Polyurethane Dispersion (Daotan VTW-1265, by Vianova) | 3 |
| Polyethylene Glycol (Carbowax PEG-400, By Union Carbide) | 2 |

PVP-containing image release layer formulation 1 is prepared by slowly incorporating the Luvicross M into the water with stirring. Once the addition of the Luvicross M is complete, the other components are added with stirring to the point where no cavitation occurs. The order of mixing the additional components is not important.

Example 11

This example relates to is a PCC/PVP-containing image receiving layer formulation, PVP-containing Image Receiving Layer Formulation 1:

PCC/PVP-containing Image Receiving Layer Formulation 1

| Compound | Parts (by weight) |
|---|---|
| Water | 29 |
| PCC (JETCOAT 30, Specialty PCC, by Specialty Minerals) | 52 |
| PVP (Luvicross M, crosslinked PVP by BASF) | 11 |
| Emulsion of wax, melamine, and Fluorochemical polymer (Freepel FX-1202, by B F-Goodrich) | 6 |
| Cationic Polymer (OSC-470, by Ontario Specialty Coatings) | 2 |

PCC/PVP-containing image release layer formulation 1 is prepared by slowly incorpating the Luvicross M into the water with stirring. Once the addition of the Luvicross M is complete, the other components are added with stirring to the point where no cavitation occurs. The order of mixing the additional components is not important.

Example 12

A transfer sheet according to the present invention is prepared as follows:

A paper support is coated with a barrier layer of Barrier Layer Formulation 1. A heat release layer of Heat Release Layer Formulation 1 is then applied on top of the barrier layer. A PCC-containing image receiving layer of PCC-containing Image Receiving Layer Formulation 1 is then applied on top of the heat release layer. The following table can be used as a guide to determine optimum coating weights and thickness of the Barrier, Release and PCC-containing Image Receiving Layers:

| | Coat Weights and Thickness | | | |
|---|---|---|---|---|
| | Parts | Wet Coat ($g/m^2$) | Dry Coat ($g/m^2$) | Thickness (mil) |
| Barrier Layer | 50 | 28 | 2 to 20 | 0.05 to 0.80 |
| Release Layer | 95 | 96.2 | 12 to 50 | 0.48 to 2.00 |
| PCC-Containing Image Receiving Layer | 100 | 20 | 2 to 25 | 0.05 to 1.0 |

Next, an image is formed on the PCC-containing image receiving layer by means of an ink jet printer.

The transfer of the image area from the image transfer sheet is completed by placing a 100% cotton shirt into a hard surface, applying heat and pressure from a conventional iron set on its highest temperature setting for a time sufficient to transfer the image area to the shirt (e.g. 3–5 minutes) and then removing the printed shirt from the hard surface. The fused expended transfer sheet is manually removed from the shirt to provide a printed shirt having excellent hand and a clear printed image.

Example 13

Example 12 is repeated with the exception of replacing of PCC-containing Image Receiving Layer Formulation 1 with of PCC-containing Image Receiving Layer Formulation 2.

Example 14

A transfer sheet according to the present invention is prepared as follows:

A paper support is coated with a barrier layer of Barrier Layer Formulation 1. A heat release layer of Heat Release Layer Formulation 1 is then applied on top of the barrier layer. A PCC-containing image receiving layer of PVP-containing Image Receiving Layer Formulation 1 is then applied on top of the heat release layer. The following table can be used as a guide to determine optimum coating weights and thickness of the Barrier, Release and PVP-containing Image Receiving Layers:

| | Coat Weights and Thickness | | | |
|---|---|---|---|---|
| | Parts | Wet Coat ($g/m^2$) | Dry Coat ($g/m^2$) | Thickness (mil) |
| Barrier Layer | 50 | 28 | 2 to 20 | 0.05 to 0.80 |
| Release Layer | 95 | 96.2 | 12 to 50 | 0.48 to 2.00 |
| PVP-Containing Image Receiving Layer | 100 | 80 | 2 to 100 | 0.05 to 2.00 |

Next, an image is formed on the PVP-containing image receiving layer by means of an ink jet printer.

The transfer of the image area from the image transfer sheet is completed by placing a 100% cotton shirt into a hard surface, applying heat and pressure from a conventional iron set on its highest temperature setting for a time sufficient to transfer the image area to the shirt (e.g. 3–5 minutes) and then removing the printed shirt from the hard surface. The fused expended transfer sheet is manually removed from the shirt to provide a printed shirt having excellent hand and a clear printed image.

Example 15

A transfer sheet according to the present invention is prepared as follows:

A paper support is coated with a barrier layer of Barrier Layer Formulation 1. A heat release layer of Heat Release Layer Formulation 1 is then applied on top of the barrier layer. A PCC-containing image receiving layer of PCC/PVP-containing Image Receiving Layer Formulation 1 is then applied on top of the heat release layer. The following table can be used as a guide to determine optimum coating weights and thickness of the Barrier, Release and PCC/PVP-containing Image Receiving Layers:

| | Coat Weights and Thickness | | | |
|---|---|---|---|---|
| | Parts | Wet Coat ($g/m^2$) | Dry Coat ($g/m^2$) | Thickness (mil) |
| Barrier Layer | 50 | 28 | 2 to 20 | 0.05 to 0.80 |
| Release Layer | 95 | 96.2 | 12 to 50 | 0.48 to 2.00 |
| PCC/PVP-Containing Image Receiving Layer | 100 | 90 | 2 to 100 | 0.05 to 2.00 |

Next, an image is formed on the PCC/PVP-containing image receiving layer by means of an ink jet printer.

The transfer of the image area from the image transfer sheet is completed by placing a 100% cotton shirt into a hard surface, applying heat and pressure from a conventional iron set on its highest temperature setting for a time sufficient to transfer the image area to the shirt (e.g. 3–5 minutes) and then removing the printed shirt from the hard surface. The fused expended transfer sheet is manually removed from the shirt to provide a printed shirt having excellent hand and a clear printed image.

Example 16

A transfer sheet according to the present invention is prepared as follows:

A paper support is coated with a release layer of Release Layer Formulation 1. The following table can be used as a guide to determine optimum coating weights and thickness of the Release Layer:

| | Coat Weights and Thickness | | | |
|---|---|---|---|---|
| | Parts | Wet Coat ($g/m^2$) | Dry Coat ($g/m^2$) | Thickness (mil) |
| Release Layer | 95 | 96.2 | 12 to 50 | 0.48 to 2.00 |

Next, an image is formed on the release layer by means of offset printing. The transfer of the image area from the image transfer sheet is completed by placing a 100% cotton shirt into a hard surface, applying heat and pressure from a conventional iron set on its highest temperature setting for a time sufficient to transfer the image area to the shirt (e.g. 3–5 minutes) and then removing the printed shirt from the hard surface. The fused expended transfer sheet is manually removed from the shirt to provide a printed shirt having excellent hand and a clear printed image.

Example 17

A transfer sheet according to the present invention is prepared as follows:

A paper support is coated with a release layer of Release Layer Formulation 1. A PCC-containing image receiving layer of PCC-containing Image Receiving Layer Formulation 1 is then applied on top of the release layer. The following table can be used as a guide to determine optimum coating weights and thickness of the Release and PCC-containing Image Receiving Layers:

| | Coat Weights and Thickness | | | |
|---|---|---|---|---|
| | Parts | Wet Coat ($g/m^2$) | Dry Coat ($g/m^2$) | Thickness (mil) |
| Release Layer | 95 | 96.2 | 12 to 50 | 0.48 to 2.00 |
| PCC-Containing Image Receiving Layer | 100 | 20 | 2 to 25 | 0.05 to 1.0 |

Next, an image is formed on the PCC-containing image receiving layer by means of an ink jet printer. The transfer of the image area from the image transfer sheet is completed by placing a 100% cotton shirt onto a hard surface, applying heat and pressure from a conventional iron set on its highest temperature setting for a time sufficient to transfer the image area to the shirt (e.g. 3–5 minutes) and then removing the printed shirt from the hard surface. The fused expended transfer sheet is manually removed from the shirt to provide a printed shirt having excellent hand and a clear printed image.

Example 18

This example relates to a transfer blocking overcoat layer formulation (all % are % by weight based on the total weight of the formulation).

| Formulation A | |
|---|---|
| Eb 745 | 50% |
| OTA-480 | 40% |
| Eb P115 | 4% |
| Eb BPO | 5% |
| PA 11 | 0.5% |
| Byk 344 | 0.5% |

Eb 745 is an acrylic oligomer, OTA-480 is a propoxylated glycerol triacrylate monomer, Eb P115 is an amine-functional acrylate additive, Eb BPO is benzophenone, PA 11 is a photoinitiator, and Byk is a silicone additive. All components are products of UCB-Radcure, except for Byk 344 which is a product of BYK Chemie (USA). Formulation A is prepared by mixing the above-listed components in their listed order under gentle stirring.

Example 19

This example relates to another transfer blocking overcoat layer formulation (all % are % by weight based on the total weight of the formulation).

| Formulation B | |
|---|---|
| Eb 3600 | 18% |
| DPHPA | 15% |
| HDODA | 7% |
| Eb 350 | 0.5% |
| Eb BPO | 7% |
| Tego Airex | 0.5% |

Eb 3600 is an imine-modified Bisphenol A epoxy acrylate resin, DPHPA is an acrylated dipentaerythritol, HDODA is a 1,6-hexanediol diacrylate, Eb 350 is an acrylated silicone, Eb BPO is benzophenone. All components are products of UCB-Radcure, except for Tego Airex which a product of Tego Chemie Service (USA). Formulation B is prepared by mixing the above-listed components in their listed order under gentle stirring.

Example 20

This Example demonstrates the image transfer procedure. Referring to FIG. 3, to transfer the image, (1) the support 21 is placed image side against a receptor (tee shirt) of the present invention. The receptor of this example includes but is not limited to cotton fabric, cotton blend fabric, glass and ceramic. A transfer device of the present invention (i.e., a hand iron or heat press) is used to apply heat to the substrate second surface of the support, which in turn releases the image areas 26. The temperature of the hand iron is about 190° C. The heat press operates at a temperature transfer range of about 190° C. (2) The transfer device is placed over the second surface of the support 21 and moved in a circular motion (if the hand iron is used). Usual pressure applied when ironing is applied as the heating device is moved over the support 21. After about 180 seconds (15 seconds if using the heat press) of heat and pressure, the transfer device is removed from the support 21. The support 21 is allowed to cool for about five minutes. (3) The support 21 is then peeled away from the receptor.

Example 21

This example relates to another method of applying an image to a receptor element will be described. More specifically, FIG. 3 illustrates how the step of heat transfer from the transfer sheet 50 to a tee shirt or fabric 62 is performed.

The transfer sheet is prepared as described in the Example 13. A tee shirt 62 is laid flat, as illustrated, on an appropriate support surface, and the image surface of the transfer sheet 50 is positioned onto the tee shirt. An iron 64 set at its highest heat setting is run and pressed across the back 52A of the transfer sheet. The image and non-image areas are transferred to the tee shirt and the transfer sheet is removed and discarded.

Example 22

A transfer sheet of the present invention is prepared according to Example 13, however, the image is applied with a conventional laser copier.

The resulting image is transferred as in Example 20, above.

Example 23

Example 13 is repeated, except that once the PCC-containing image receiving layer has completely dried, the following antistatic layer is coated on the backside of the support (the previously non-coated side).

| Antistatic Layer Solution Formulation 1 | |
|---|---|
| Water | 90 parts (by weight) |
| Quaternary ammonium salt solution (Statik-Blok J-2, Amstat Industries) | 10 parts (by weight) |

The antistatic solution is applied in a long line across the top edge of the substrate using a #4 metering rod. The coated support is force air dried for approximately one minute.

The antistatic solution of this Example has the following characteristics: the solution viscosity as measured on a Brookfield DV-I+ viscometer, LV1 spindle @ 60 RPM is 2.0 (cP) at 24.5° C. The coating weights (wet) are 10 to 20 g/m$^2$. The surface tension is 69.5 dynes/cm at 24° C.

Once the support and antistatic coating are dry, the coated transfer sheet is placed into an electrostatic printer and imaged upon.

Example 24

Example 23 is repeated, except that following formulation is used as the antistatic layer and is coated on the backside of the substrate (the previously non-coated side):

| Antistatic Layer Solution Formulation 2 | |
|---|---|
| Water | 90 parts (by weight) |
| Polyether (Marklear ALF-23, Witco Ind.) | 5 parts (by weight) |

Example 25

This example relates to a release layer formulation wherein Release Layer Formulation 1 formulated with precipitated calcium carbonate. This new release layer formulation is then coated over a support already having a barrier layer coated thereon.

| 77% Precipitated Calcium Carbonate Composition | |
|---|---|
| Component | Weight (g) |
| Calcium Acetate (Aldrich Chemical) | 15 |
| Sodium Carbonate (Aldrich Chemical) | 15.8 |
| Release Layer Formulation 1 | 66 |

Sixty-six grams of Release Layer Formulation 1 is enough material to coat about one (1) meter square of support once the salt precipitation reaction is brought to completion. Fifteen grams (15 g) of Calcium Acetate is dissolved into about 10 grams of Release Layer Formulation 1. Fifteen and eight tenths (15.8 g) grams of Sodium Carbonate is dissolved into 56 grams of Release Layer Formulation One under gentle stirring. Under condition of rapid stirring, the 10 grams of the Calcium Acetate containing Release Layer Formulation 1 is rapidly injected into the 56 grams of Sodium Carbonate-containing Release Layer Formulation 1. After a reaction time of five (5) seconds, the solution is coated onto Barrier Formulation 1 coated support using a #30 metered rod. The coating is force air dried prior to ink jet printing.

Example 26

A greeting card according to the present invention is prepared as follows.

A conventional greeting card is prepared, however, a portion of the support of the greeting card is reserved for the transfer material. This "reserved portion" of the support of the greeting card is divided from the remainder of the greeting card by a perforation as illustrated in FIG. 4. Next, a transfer sheet according to Example 17 is prepared except the "reserved portion" of the support of the greeting card serves as the support of the transfer material of Example 17. In other words, all layers of Example 17 are coated onto all or a portion of the "reserved portion" of the support of the greeting card. Next, the perforations are separated by tearing, thus creating an independent transfer sheet. The image is then transferred as in Example 20, above.

Example 27

Example 26 is repeated except that the transfer sheet is replaced with the silver halide transfer sheet according to Example 17 of U.S. Provisional Application 60/148,652, wherein the silver halide emulsion layer and the transfer layer are independent layers.

Example 28

Example 27 is repeated except the silver halide emulsion layer and the transfer layer are combined in the same layer.

Example 29

Example 26 is repeated except that the transfer sheet is replaced with the photosensitive microcapsule transfer sheet according to Example 19 of U.S. Provisional Application 60/148,652, wherein the photosensitive microcapsule layer and the transfer layer are independent layers.

Example 30

Example 29 is repeated except the photosensitive microcapsule layer and the transfer layer are contained in the same layer.

Example 31

Example 26 is repeated except that the transfer sheet is replaced with the light-fixable thermal recording sheet according to Example 21 of U.S. Provisional Application 60/148,652, wherein the light-fixable thermal recording layer is coated over the transfer layer.

Example 32

Example 31 is repeated except that microcapsule-containing direct thermal recording imaging element is dispersed in the transfer layer.

Example 33

A greeting card according to the present invention is prepared as follows.

A transfer sheet according to Example 17 with the exception that the support is made as a removable portion of a greeting card. As shown in FIG. 5, the transfer sheet is placed in a pocket within the greeting card. The transfer sheet is removed from the pocket and transferred as in Example 20, above.

Example 34

A greeting card according to the present invention is prepared as follows.

A conventional greeting card is prepared, however, a portion of the support of the greeting card is reserved for the transfer material. This "reserved portion" of the support of the greeting card serves as the support of the transfer material, which support is integral with the greeting card. Next, a transfer sheet according to Example 17 is prepared except the "reserved portion" of the support of the greeting card serves as the support of the transfer material of Example 17. In other words, all layers of Example 17 are coated onto all or a portion of the "reserved portion" of the support of the greeting card. The image is then transferred directly from the greeting card support to the receptor element as in Example 20, above.

Example 35

| Pressure Sensitive Adhesive Layer Formulation 1 | |
|---|---|
| Ingredient | Parts |
| Acrylic Polymer Adhesive (Grafix-2000, Super-Tek Products Inc., Woodside, KY) | 95.0 |
| Water | 5.0 |

The Grafix-2000 as used above is diluted to a high viscosity. The two components mix in the presence of a stir bar at low stir speeds. The mixing is done at room temperature.

Example 36

A heat-setting label sheet of the present invention is prepared as follows:

Pressure Sensitive Adhesive Layer Formulation 1 is prepared as described in Example 35 and is coated onto a silicone coated release base to a thickness of 0.4 mils (wet).

After the Pressure Sensitive Adhesive Layer dries, Release Layer Formulation 1 of Example is coated on top of the Pressure Sensitive Adhesive Layer to a thickness of 3 mils (wet).

After the Release Layer dries, Image Receiving Layer Formulation 1 as described in Example 9 is coated onto the Release Layer to a thickness of 1.0 mil (wet).

After the Image Receiving Layer dries, the heat-setting label sheet is imaged using an ink jet printer and transferred.

Example 37

The heat-setting label sheet of Example 36 is transferred as follows:

The heat-setting label sheet is imaged using an ink jet printer. The Release Layer, and the Image Receiving Layer (the label portion) having the image thereon are peeled away from the base and placed on a tee shirt Release Layer down. Part of the Pressure Sensitive Adhesive Layer remains connected to the Release Layer and helps to provide some tackiness that holds the label portion adhered to the substrate. A tack-free sheet is placed over the imaged image receiving layer.

A hand iron on a high setting is used to apply heat to the back of the tack-free sheet, which activates the heat-setting material and permanently adheres the image to the tee shirt. Typical pressure applied during ironing is applied to the label for a period of three minutes. Finally, the hand iron and tack-free sheet are removed from the tee shirt.

Example 38

An example of Opaque Layer A is as follows:

| Opaque Layer A Formulation 1 | |
|---|---|
| Ingredient | Parts |
| Sryrene-Butadiene Latex (Latex CP 615NA, Dow Chemical Co., Midland, MI) | 40 |
| Pigment in Resin Solution (Arrowvure F. Funk Ink CO., W. Hazelton, PA) | 25 |

-continued

| Opaque Layer A Formulation 1 | |
|---|---|
| Ingredient | Parts |
| Thermoplastic Elastomer (Hystretch V-29, B F Goodrich, Cleveland, OH) | 17.5 |
| Elastomer (Hycar 1561, B F Goodrich, Cleveland, OH) | 17.5 |

Example 39

An example of Opaque Layer B is as follows:

| Opaque Layer B Formulation 1 | |
|---|---|
| Ingredient | Parts |
| Vinyl Acetate-Ethylene Copolymer (Airflex 124, Airproducts Inc., Allentown, PA) | 35 |
| TiO2 Powder Pigment (TiPure R706, DuPont Chemicals, Wilmington, DE) | 25 |
| Thermoplastic Elastomer (Hystretch V-29, B F Goodrich, Cleveland, OH) | 25 |
| Elastomer (Hycar 1561, B F Goodrich, Cleveland, OH). | 15 |

Example 40

A heat-setting label sheet of the present invention is prepared as follows:

Pressure Sensitive Adhesive Layer Formulation 1 is prepared as described in Example 35 and is coated onto a silicone coated release base to a thickness of 0.4 mils (wet).

After the Pressure Sensitive Adhesive Layer dries, Release Layer Formulation 1 of Example 6 is coated on top of the Pressure Sensitive Adhesive Layer to a thickness of 3 mils (wet).

After the Release Layer dries, Opaque Layer A as described in Example 38 is coated on top of the Release Layer to a thickness of 1.5 Mils (wet).

After Opaque Layer A dries, Opaque Layer B of Example 39 is coated on top of Opaque Layer A to a thickness of 1.5 mils (wet).

After Opaque layer B dries, Image Receiving Layer Formulation 1 as described in Example 9 is coated on top to a thickness of 1.0 mil (wet).

After the Image Receiving Layer dries, the heat-setting label sheet is imaged using an ink jet printer and transferred. The transfer is conducted in a manner similar to Example 37.

All cited patents, publications, copending applications, and provisional applications referred to in this application are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A greeting card which contains a transfer sheet, comprising:

a greeting portion; and a transfer sheet, said transfer sheet comprising:

(a) a support having a front and a back surface, wherein said support exists independently within said greeting or said support is integral with said greeting card;

(b) at least one pressure sensitive adhesive layer applied on the front surface of said support, wherein said at least one pressure sensitive adhesive layer comprises at least one of a polyester, acrylic polymer, or copolymer blend, said polyester, acrylic polymer, or copolymer blend having a glass transition temperature (Tg) of less than 0° C.;

(c) at least one transfer layer applied over said pressure sensitive adhesive layer; and (d) an image or an image receiving layer applied over said at least one transfer layer, wherein (a) materials that constitute said transfer layer and said image or image receiving layer may be combined in a same layer, and (b) said image or an image placed on or within said image receiving layer may be transferred to a receptor element, provided that when said transfer sheet in said greeting card consists of (1) a support, and (2) an image, said image is not formed using a transferable ink.

2. A process for heat transferring an imaged area from a transfer sheet to a receptor, comprising the steps:

removing or detaching the transfer sheet from the greeting portion of claim 1;

contacting a receptor with an outermost layer on the front surface of the support;

applying heat and pressure to an outermost layer on the back surface of the support sufficient to transfer an image to said receptor to form an imaged receptor; and removing said image transfer sheet from said imaged receptor.

3. A process for heat transferring an imaged area from a transfer sheet to a receptor, comprising the steps:

providing a greeting card according to claim 1, wherein the support is integral with the greeting portion;

contacting a receptor with an outermost layer on the front surface of the support;

applying heat and pressure to an outermost layer on the back surface of the support sufficient to transfer an image to said receptor to form an imaged receptor; and removing said image transfer sheet from said imaged receptor.

4. The greeting card according to claim 1, wherein said pressure sensitive adhesive layer comprises an acrylic polymer.

5. A process for heat transferring an imaged area from a transfer sheet to a receptor, comprising the steps:

peeling the transfer layer having the image thereon from the support of the transfer sheet of the greeting card according to claim 1;

placing the transfer layer having the image thereon onto the receptor element;

placing a tack-free sheet on top of the transfer layer having the image thereon;

applying heat and pressure to the tack-free sheet sufficient to transfer said image to said receptor to form an imaged receptor; and removing the tack-free sheet.

6. A kit, comprising:

a greeting card according to claim 1, and a tack-free sheet.

7. A greeting card which contains a transfer sheet, comprising:

a greeting card; and a transfer sheet, said transfer sheet comprising:

(a) a support;

a pressure sensitive adhesive layer comprising at least one of a polyester, acrylic polymer, or copolymer blend, said polyester, acrylic polymer, or copolymer blend having a glass transition temperature (Tg) of less than 0° C.; and a transfer layer comprising a thermoplastic polymer which melts in the range of 50–250° C., a wax which melts in the range of 50–250° C., or combinations thereof;

wherein said pressure sensitive adhesive layer is on the support and said transfer layer is on the pressure sensitive adhesive layer;

or (b) a support;

a barrier layer coated on the support, said barrier layer comprising (1) a vinyl acetate with a $T_g$ in the range of −10° C. to 100° C.; (2) a thermoplastic polymer having essentially no tack at transfer temperatures, a solubility parameter of at least 19 (Mpa)½, and a glass transition temperature of at least 0° C., or (3) thermosetting polymers, ultraviolet curing polymers, or combinations thereof; and a transfer layer coated on the barrier layer and comprising a thermoplastic polymer which melts in the range of 50–250° C., a wax which melts in the range of 50–250° C., or combinations thereof.

8. A method of heat transferring an imaged area from a transfer sheet to a receptor element, comprising the steps:

imaging the transfer sheet of the greeting card according to claim 7;

peeling the transfer layer having the image thereon from the support of the transfer sheet;

placing the transfer layer having the image thereon onto the receptor element;

placing a tack-free sheet on top of the transfer layer having the image thereon;

applying heat and pressure to the tack-free sheet sufficient to transfer said image to said receptor to form an imaged receptor; and removing the tack-free sheet.

9. The greeting card according to claim 7, wherein said transfer sheet further comprises a first opaque layer positioned on the transfer layer, wherein said first opaque layer comprises a styrene-butadiene latex, optional pigment, thermoplastic polymer, and elastomer.

10. The greeting card according to claim 7, wherein said transfer sheet further comprises an image receiving layer coated on the transfer layer, which image receiving layer comprises at least one polymer which is capable of receiving and retaining water base colorants, said image receiving layer either does not melt when heat is applied or melts at a temperature above a melting temperature of the transfer layer.

11. A kit, comprising:

a greeting card according to claim 7, and a tack-free sheet.

12. The method according to claim 8, wherein the image side is not directly placed against the receptor element.

13. The method according to claim 8, wherein the image side is directly placed against the receptor element.

14. The method according to claim 8, wherein said transfer sheet is detached from said greeting card prior to imaging.

15. The greeting card according to claim 9, wherein said transfer sheet further comprises a second opaque layer comprising vinyl acetate-ethylene copolymer, optional pigment, thermoplastic elastomer and elastomer, wherein said second opaque layer is coated on the first opaque layer.

16. The greeting according to claim 13, wherein said transfer material further comprises an image receiving layer coated on said first opaque layer which comprises at least one polymer which is capable of receiving and retaining water base colorants, said image receiving layer either does not melt when heat is applied or melts at a temperature above a melting temperature of the transfer layer.

17. The greeting card according to claim 15, wherein said transfer sheet further comprises an image receiving layer coated on said second opaque layer which comprises at least one polymer which is capable of receiving and retaining water base colorants, said image receiving layer either does not melt when heat is applied or melts at a temperature above a melting temperature of the transfer layer.

18. A transferable greeting card, comprising:

a transfer sheet, said transfer sheet comprising:

(a) a support having a front and a back surface;

(b) at least one pressure sensitive adhesive layer applied on the front surface of the support, wherein said at least one pressure sensitive adhesive layer comprises at least one of a polyester, acrylic polymer, or copolymer blend, said polyester, acrylic polymer, or copolymer blend having a glass transition temperature (Tg) of less than 0° C.;

(c) at least one transfer layer applied over said at least one pressure sensitive adhesive layer;

(d) an optional image receiving layer applied over said at least one transfer layer; and (e) an image applied over said at least one transfer layer or said optional image receiving layer, wherein (a) said transfer layer and said image or image receiving layer may be combined in a same layer, and (b) said image or an image placed on or within said image receiving layer may be transferred to a receptor element, with the proviso that when said transfer sheet in said greeting card consists of (1) a support, and (2) an image, said image is not formed using a transferable ink.

19. The transferable greeting card according to claim 18, wherein said support forms the entire greeting card and said transfer layer is coated on all of the support of the greeting card.

20. The transferable greeting card according to claim 18, wherein said at least one pressure sensitive adhesive layer comprises an acrylic polymer.

21. A process for transferring image and non-image areas from a transfer sheet to a receptor, comprising the steps:

peeling the transfer layer having the image thereon from the support of the transfer sheet of the transferable greeting card according to claim 18 or 19;

placing the transfer layer having the image thereon onto the receptor element;

placing a tack-free sheet on top of the transfer layer having the image thereon;

applying heat and pressure to the tack-free sheet sufficient to transfer said image to said receptor to form an imaged receptor; and removing the tack-free sheet.

22. A kit, comprising:

a greeting card according to claim 18, and a tack-free sheet.

23. The process according to claim 21, further comprising:

personalizing the imaged transferable greeting card prior to said step of peeling, wherein said step of personalizing is accomplished by manually and/or electronically placing an image or design on the transfer sheet.

24. The method according to claim 21, wherein the image side is not directly placed against the receptor element.

25. The method according to claim 21, wherein the image side is directly placed against the receptor element.

26. A transferable greeting card, comprising:

a transfer sheet, said transfer sheet comprising:

(a) a support;

a pressure sensitive adhesive layer comprising at least one of a polyester, acrylic polymer, or copolymer blend, said polyester, acrylic polymer, or copolymer blend having a glass transition temperature (Tg) of less than 0° C.; and a release layer comprising a thermoplastic polymer which melts in the range of 50–250° C., a wax which melts in the range of 50–250° C., or combinations thereof;

wherein said pressure sensitive adhesive layer is on the support and said release layer is on the pressure sensitive adhesive layer;

or (b) a support; and a barrier layer coated on the support, said barrier layer comprising (1) a vinyl acetate with a $T_g$ in the range of −10° C. to 100° C.; (2) a thermoplastic polymer having essentially no tack at transfer temperatures, a solubility parameter of at least 19 (Mpa) ½, and a glass transition temperature of at least 0° C., or (3) thermosetting polymers, ultraviolet curing polymers, or combinations thereof; and an Adhesion Layer coated on the barrier layer and comprising a thermoplastic polymer which melts in the range of 50–250° C., a wax which melts in the range of 50–250° C., or combinations thereof.

27. A greeting card which contains a transfer sheet, comprising:

a greeting card; and a transfer sheet, said transfer sheet comprising:

(a) a support, wherein said support exists independently within said greeting or said support is integral with said greeting card;

a pressure sensitive adhesive layer comprising at least one of a polyester, acrylic polymer, or copolymer blend, said polyester, acrylic polymer, or copolymer blend having a glass transition temperature (Tg) of less than 0° C.; and a release layer comprising a thermoplastic polymer which melts in the range of 50–250° C., a wax which melts in the range of 50–250° C., or combinations thereof;

wherein said pressure sensitive adhesive layer is on the support and said release layer is on the pressure sensitive adhesive layer;

or (b) a support, wherein said support exists independently within said greeting or said support is integral with said greeting card;

a barrier layer coated on the support, said barrier layer comprising (1) a vinyl acetate with a Tg in the range of −10° C. to 100° C.; (2) a thermoplastic polymer having essentially no tack at transfer temperatures, a solubility parameter of at least 19 (Mpa)½, and a glass transition temperature of at least 0° C., or (3) thermosetting polymers, ultraviolet curing polymers, or combinations thereof; and an adhesion layer coated on the barrier layer and comprising a thermoplastic polymer which melts in the range of 50–250° C., a wax which melts in the range of 50–250° C., or combinations thereof.

28. The greeting card according to claim 27, wherein said transfer sheet further comprises a first opaque layer positioned on the release layer, wherein said first opaque layer comprises a styrene-butadiene latex, optional pigment, thermoplastic polymer, and elastomer.

29. A method of heat transferring an imaged area from a transfer sheet to a receptor element, comprising the steps:

imaging the transfer sheet of the greeting card according to claim 27;

peeling the transfer layer having the image thereon from the support of the transfer sheet;

placing the transfer layer having the image thereon onto the receptor element;

placing a tack-free sheet on top of the transfer layer having the image thereon;

applying heat and pressure to the tack-free sheet sufficient to transfer said image to said receptor to form an imaged receptor; and removing the tack-free sheet.

30. A kit, comprising:

a greeting card according to claim 27, and a tack-free sheet.

31. The greeting card according to claim 28, wherein said transfer sheet further comprises a second opaque layer comprising vinyl acetate-ethylene copolymer, optional pigment, thermoplastic elastomer and elastomer, wherein said second opaque layer is coated on the first opaque layer.

32. The greeting card of claim 28, wherein said transfer sheet further comprises an image receiving layer coated on said first opaque layer which comprises at least one polymer which is capable of receiving and retaining water base colorants, said image receiving layer either does not melt when heat is applied or melts at a temperature above a melting temperature of the release layer.

33. The greeting card according to claim 31, wherein said transfer sheet further comprises an image receiving layer coated on said second opaque layer which comprises at least one polymer which is capable of receiving and retaining water base colorants, said image receiving layer either does not melt when heat is applied or melts at a temperature above a melting temperature of the release layer.

34. A transferable greeting card, comprising:

a transfer sheet, said transfer sheet comprising:

(a) a support having a front and a back surface, (b) a pressure sensitive adhesive layer applied over the support;

(c) at least one transfer layer applied over said pressure sensitive adhesive layer;

(d) an optional image receiving layer applied over said at least one transfer layer; and (e) an image applied over said at least one transfer layer or said optional image receiving layer, wherein (a) said transfer layer and said image or image receiving layer may be combined in a same layer, and (b) said image or an image placed on or within said image receiving layer may be transferred to a receptor element.

35. The transferable greeting card according to claim 34, wherein said pressure sensitive adhesive comprises at least one of a polyester, acrylic polymer, or copolymer blend, said polyester, acrylic polymer, or copolymer blend having a glass transition temperature (Tg) of less than 0° C.

36. A process for transferring image and non-image areas from a transfer sheet to a receptor, comprising the steps:

peeling the transfer layer having the image thereon from the support of the transfer sheet of the transferable greeting card according to claim 34;

placing the transfer layer having the image thereon onto the receptor element;

placing a tack-free sheet on top of the transfer layer having the image thereon;

applying heat and pressure to the tack-free sheet sufficient to transfer said image to said receptor to form an imaged receptor; and removing the tack-free sheet.

37. A kit, comprising:

a greeting card according to claim 34, and a tack-free sheet.

38. The process according to claim 36, further comprising:

personalizing the imaged transferable greeting card, wherein said step of personalizing is accomplished by manually and/or electronically placing an image and/or design on the transfer sheet.

39. The method according to claim 36, wherein the image side is not directly placed against the receptor element.

40. The method according to claim 36, wherein the image side is directly placed against the receptor element.

41. The process according to claim 38, wherein said step of personalizing occurs prior to said step of applying heat and pressure.

42. A transferable greeting card, comprising:

a transfer sheet, said transfer sheet comprising:

(a) a support;

a pressure sensitive adhesive layer comprising at least one of a polyester, acrylic polymer, or copolymer blend, said polyester, acrylic polymer, or copolymer blend having a glass transition temperature (Tg) of less than 0° C.; and a release layer comprising a thermoplastic polymer which melts in the range of 50–250° C., a wax which melts in the range of 50–250° C., or combinations thereof;

wherein said pressure sensitive adhesive layer is on the support and said release layer is on the pressure sensitive adhesive layer; or (b) a support;

a barrier layer coated on the support, said barrier layer comprising (1) a vinyl acetate with a Tg in the range of −10° C. to 100° C.; (2) a thermoplastic polymer having essentially no tack at transfer temperatures, a solubility parameter of at least 19 (Mpa)½, and a glass transition temperature of at least 0° C., or (3) thermosetting polymers, ultraviolet curing polymers, or combinations thereof; and an adhesion layer coated on the barrier layer and comprising a thermoplastic polymer which melts in the range of 50–250° C., a wax which melts in the range of 50–250° C., or combinations thereof.

43. A kit, comprising:

a greeting card according to claim 42, and a tack-free sheet.

44. A greeting card which contains a transfer sheet, comprising:

a greeting portion; and a transfer sheet, said transfer sheet comprising:

(a) a support having a front and a back surface, wherein said support exists independently within said greeting or said support is integral with said greeting card, (b) a pressure sensitive adhesive layer over the front surface of said support;

(c) at least one transfer layer applied over said pressure sensitive adhesive layer; and (d) an image or an image receiving layer applied over said at least one transfer layer, wherein (1) materials that constitute said transfer layer and said image or image receiving layer may be combined in a same layer, and (2) said image or an image placed on or within said image receiving layer may be transferred to a receptor element.

45. The greeting card according to claim 44, wherein said pressure sensitive adhesive comprises at least one of a polyester, acrylic polymer, or copolymer blend, said polyester, acrylic polymer, or copolymer blend having a glass transition temperature (Tg) of less than 0° C.

46. A process for heat transferring an imaged area from a transfer sheet to a receptor, comprising:

removing or detaching the transfer sheet from the greeting portion of claim 44;

contacting a receptor with an outermost layer on the front surface of the support;

applying heat and pressure to an outermost layer on the back surface of the support sufficient to transfer an image to said receptor to form an imaged receptor; and removing said image transfer sheet from said imaged receptor.

47. A process for heat transferring an imaged area from a transfer sheet to a receptor, comprising the step;

providing a greeting card according to claim 44, wherein the support is integral with the greeting portion;

contacting a receptor with an outermost layer on the front surface of the support;

applying heat and pressure to an outermost layer on the back surface of the support sufficient to transfer an image to said receptor to form an imaged receptor; and removing said image transfer sheet from said imaged receptor.

48. A process for heat transferring an imaged area from a transfer sheet to a receptor, comprising the steps:

peeling the transfer layer having the image thereon from the support of the transfer sheet of the greeting card according to claim 44;

placing the transfer layer having the image thereon onto the receptor element;

placing a tack-free sheet on top of the transfer layer having the image thereon;

applying heat and pressure to the tack-free sheet sufficient to transfer said image to said receptor to form an imaged receptor; and removing the tack-free sheet.

49. A kit, comprising:

a greeting card according to claim 44, and a tack-free sheet.

50. A process for transferring image and non-image areas from a transfer sheet to a receptor, comprising the steps:

peeling the transfer layer having the image thereon from the support of the transfer sheet of the transferable greeting card according to claim 42;

placing the transfer layer having the image thereon onto the receptor element;

placing a tack-free sheet on top of the transfer layer having the image thereon;

applying heat and pressure to the tack-free sheet sufficient to transfer said image to said receptor to form an imaged receptor; and removing the tack-free sheet.

51. The process according to claim 50, further comprising:

personalizing the imaged transferable greeting card, wherein said step of personalizing is accomplished by manually and/or electronically placing an image and/or design on the transfer sheet.

52. The process according to claim 50, wherein the image side is not directly placed against the receptor element.

53. The method according to claim 50, wherein the image side is directly placed against the receptor element.

54. The process according to claim 51, wherein said step of personalizing occurs prior to said step of applying heat and pressure.

* * * * *